US005932406A

United States Patent [19]

Adegawa et al.

[11] Patent Number: 5,932,406

[45] **Date of Patent: *Aug. 3, 1999**

[54] SILVER HALIDE PHOTOGRAPHIC MATERIAL

[75] Inventors: Yutaka Adegawa; Kentaro Shiratsuchi, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/686,695

[22] Filed: Jul. 26, 1996

[30] Foreign Application Priority Data

Jul. 31, 1995 [JP] Japan ..... 7-212937

[51] Int. Cl.[6] ..... G03C 1/76

[52] U.S. Cl. ..... 430/531; 430/533; 430/950

[58] Field of Search ..... 430/627, 621, 430/531, 950, 533, 640

[56] References Cited

U.S. PATENT DOCUMENTS 5,057,407 10/1991 Okamura et al. ..... 430/531

FOREIGN PATENT DOCUMENTS 0610522 2/1993 European Pat. Off. .

0618490 3/1993 European Pat. Off. .

6452138 2/1989 Japan .

559924 9/1993 Japan .

617373 3/1994 Japan .

*Primary Examiner*—Thorl Chea

*Attorney, Agent, or Firm*—Sughrue, Mion, Zinn, Macpeak & Seas, PLLC

[57] ABSTRACT

Disclosed is a silver halide photographic material which comprises a monodispersed polymer having an average grain size of from 1 to 10 $\mu$m and variation coefficient of 0.10 or less and having a functional group which forms a covalent bond by reacting with an organic hardening agent or gelatin. Preferably, the polymer is a polymer obtained by polymerization by adding to a hydrophilic organic solution a high molecular weight dispersant which is dissolved in the hydrophilic organic solution and further adding at least one vinyl monomer which is dissolved in the hydrophilic organic solution but the polymer to be formed is precipitated from the hydrophilic organic solution. More preferably, the polymer contains 60 wt % or more of the repeating unit derived from methyl methacrylate and has a glass transition point of 60° C. or more. The silver halide photographic material is excellent in antistatic property, transporting property, adhesion resistance, transparency, scratch resistance, graininess, drying property and mat pinholes.

5 Claims, No Drawings

SILVER HALIDE PHOTOGRAPHIC MATERIAL

FIELD OF THE INVENTION

The present invention relates to a silver halide photographic material, in particular, to a silver halide photographic material improved in antistatic property, transporting property, adhesion resistance, transparency, scratch resistance, graininess, drying property and mat pinholes.

BACKGROUND OF THE INVENTION

Silver halide photographic materials generally comprise a support having thereon at least one light-sensitive silver halide emulsion layer and provided thereon a surface layer, that is, a protective layer comprising hydrophilic colloid materials represented by gelatin. When such photographic materials are stored under high temperature, still further, high temperature and high humidity conditions, such a phenomenon as surfaces of photographic materials are adhered is liable to occur. This adhesion is caused by the contact of photographic materials each other or with other materials in a camera and is generated during production, use or storage of photographic materials and has been a problem.

Further, such adhesion is liable to injure the outer surfaces of photographic materials by contact of photographic materials each other or when photographic materials come into contact with devices of exposure and development processing thereof and, further, causes troubles such as failures by static electricity due to discharge generated by friction or peeling of photographic materials each other or photographic materials with or from the devices.

In addition, another problem arises such that when a photographic material is processed using an automatic processor capable of continuously developing, fixing, washing and drying, transporting property is lowered by the adhesion of a photographic material to the parts in an automatic processor.

Therefore, surface roughening (matting) by incorporating organic or inorganic fine grains (a so-called matting agent) into emulsion layers or the surface protective layer on the back side of the support of a silver halide photographic material is widely conducted for purposes of prevention of the above-described adhesion under high temperature and high humidity conditions, improvements of antistatic property, scratch resistance and transporting property, in addition, improvements of discriminating abilities of the surface side and the back side of a photographic material and vacuum contact at the time of contact exposure. Various sizes of matting agents are used according to purposes but, in general, those having sizes of from 1 $\mu$m to 10 $\mu$m are preferably used.

Examples of matting agents often used for silver halide photographic materials include inorganic materials such as silicon dioxide, titanium dioxide, magnesium oxide, calcium carbonate, magnesium carbonate, barium sulfate, and strontium sulfate, and fine grain powders of organic materials such as polymethyl acrylate, polymethyl methacrylate, polyacrylonitrile, polystyrene, cellulose acetate, and cellulose acetate propionate. Examples of these matting agents are disclosed in U.S. Pat. No. 3,411,907, British Patent 837,529 and *Research Disclosure*, Vol. 176, No. 17643 (December, 1978).

However, although the above-described problems are improved by using a matting agent, new problems arise. The above problems are improved using a large amount of a matting agent to increase the matting degree of the surface but the increased amount of a matting agent leads to deteriorations of graininess and transparency of a material.

Many of conventionally used matting agents are broad in grain size distribution, for example, for giving adhesion resistance to a silver halide photographic material, a large quantity of matting agents must be present in a surface protective layer or a backing layer, inclusive of matting agents having grain sizes not necessary. Polymer grains having grain sizes of 1 $\mu$m or less are insufficient to impart adhesion resistance to a photographic material and which causes deterioration of haze cutting, therefore, such a matting agent is not desired in a photographic material requiring transparency. Further, polymer grains having grain sizes of 10 $\mu$m or more are not preferred as they deteriorate graininess of an image, in addition, such polymer grains have a drawback such that they precipitate in a coating solution or generate agglomerates and make coating difficult. Therefore, such big polymer grains are necessary to be removed as much as possible.

These two points, that is, deteriorations of graininess and transparency, appear markedly when a development processed photographic material containing a matting agent is enlargement printed or projected using a specular light source or copied using the same light source (for example, optical print in the movies).

Moreover, when a large amount of a matting agent is used, an undesired defect is often caused such as micro-holes (pinholes) are dotted on images due to the precipitation of the matting agent. In particular, in a photographic material of forming high contrast images by rapid processing, generation of pinholes is conspicuous when the amount of gelatin binder in the silver halide emulsion layer is reduced to heighten the rapid processability, therefore, the generation of pinholes and the reduction of optical density (blackening density) therefrom cannot be avoided by generally used matting agents having broad grain size distributions. When the amount of gelatin binder is increased to avoid the generation of pinholes, not only drying property is extremely deteriorated but also dimensional stability of a photographic material is reduced.

A technique of improving some of the above problems of antistatic property, transporting property, adhesion resistance, transparency, scratch resistance, graininess, drying property and mat pinholes by using monodispersed polymer grain as a matting agent is disclosed.

The first example of applying monodispersed polymer grains as a matting agent in a silver halide photographic material has been disclosed in *Research Disclosure*, Vol. 21617, No. 216 (1982). The disclosure has clarified that the use amount of a matting agent necessary to obtain certain frictional resistance can be reduced using monodispersed polymethyl methacrylate grains having an optimal grain size of 1.8 $\mu$m, and pinholes and coating defect due to coarse grains can be removed. However, the manufacturing method of the monodispersed matting agent and the monodispersibility (grain size distribution) thereof are not disclosed in the above *Research Disclosure*.

Further, improving effects of adhesion resistance and antistatic property by polymethyl methacrylate grains having a number-average grain size of from 0.8 to 2.3 $\mu$m synthesized by dispersion polymerization are disclosed in JP-B-5-59924 (the term "JP-B" as used herein means an "examined Japanese patent publication"), but many of the grain size distributions of the polymer grains disclosed in the same patents are broad such as from 0.19 to 1.23 in terms of variation coefficient and the improving effect of surface characteristics such as adhesion resistance has been insufficient. Compatibility of adhesion resistance and transparency is disclosed in JP-A-61-230141 (the term "JP-A" as used herein means an "unexamined published Japanese patent application"). In addition to the above patents, monodispersibilities of matting agents are disclosed in JP-A-59-

149357, JP-A-60-156056, JP-A-63-8736, JP-A-63-235314, JP-A-1-281443, JP-A-2-54249, JP-A-4-78845, JP-A-5-289225, European Patents 341200, 118793, U.S. Pat. Nos. 4,940,653, 4,614,708 and 4,885,530. Monodispersed polymer grain matting agents disclosed in these patents are clarified to have superior properties to polydispersed matting agents in adhesion resistance, graininess, transporting property, antistatic property and transparency, but these polymer grain matting agents disclosed in the above patents are generally low in monodispersibility and the improving effect of mat pinholes is insufficient.

In recent years, a technique of using polymethyl methacrylate grains having extremely high monodispersibility is disclosed in European Patents 610522 and 618490, and reported that the technique is very effective for improving adhesion resistance and antistatic property.

However, the improving effect of mat pinholes is not yet sufficient and the development of a matting agent having a higher property has been desired.

On the other hand, a technique of incorporating a functional group which forms a covalent bond by reacting with an organic hardening agent or a functional group which forms a covalent bond by reacting with gelatin into a matting agent is disclosed in JP-A-64-52138, but the technique primarily aims to prevent a matting agent from peeling off from a photographic material when a processing solution is squeegeed from a photographic material by a rubber plate or a pair of rollers, and the improvement of mat pinholes could not be achieved by this method. Further, a technique of using a matting agent individually covered with covalently bonded gelatin is disclosed in JP-A-1-158427. According to this technique, after an emulsion layer and an overcoat layer (a protective layer) are cooled, hardened and dried, a matting agent is coated thereon (successive coating) and mat pinholes are improved thereby, further, peeling off of a matting agent is prevented as the matting agent is a matting agent covered with gelatin. The patent discloses that mat pinholes cannot be improved when a matting agent not bonded with gelatin is incorporated into a protective layer and coated simultaneously with an emulsion layer.

The above successive coating has drawbacks such that the manufacturing process is complicated and expensive. Accordingly, a method of improving mat pinholes by simultaneous coating has been desired.

Besides the above-described two patents, some techniques using grains reactive with gelatin are disclosed. Grains having an average grain size of from 0.02 to 0.5 $\mu$m comprising polymers reactive with gelatin are disclosed in JP-A-62-141540, but these grains cannot sufficiently mat the surface of a photographic material. The polymer latexes having an active methylene group reactive with gelatin are disclosed in U.S. Pat. Nos. 3,700,456, 4,215,195 and 4,421,915 but these grains also cannot be used for matting the surface of a photographic material because grain sizes are small.

SUMMARY OF THE INVENTION

An object of the present invention is to provide a silver halide photographic material improved in antistatic property, transporting property, transparency, scratch resistance, drying property, and, in particular, excellent in improving mat pinholes.

The object of the present invention has been attained by a silver halide photographic material comprising a monodispersed polymer having an average grain size of from 1 to 10 $\mu$m and variation coefficient of 0.10 or less and having a functional groups which forms a covalent bond by reacting with an organic hardening agent or gelatin.

DETAILED DESCRIPTION OF THE INVENTION

The variation coefficient of the present invention is defined by the following equation (1):

$$\sqrt{\frac{\Sigma(\bar{r}-ri)^2\cdot ni}{\Sigma ni}} \div \bar{r} \tag{1}$$

wherein r represents a number-average grain size; ni represents the "i"th grain; and ri represents the grain size of the "i"th grain.

Examples of preferred functional groups which form a covalent bond by reacting with an organic hardening agent and functional groups which form a covalent bond by reacting with gelatin contained in the polymers to be used in the present invention are functional groups represented by the following formula (I), (II), (III), (IV), (V), (VI), (VII), (VIII), (IX), (X), (XI), (XII), (XIII) or (XIV) but the present invention is not limited thereto. Further, these functional groups are preferably bonded to carbon atoms of monodispersed polymer grains:

$$-SO_2^-M^+ \tag{I}$$

wherein $M^+$represents an alkali metal ion (e.g., $Na^+$, $K^+$) or an ammonium ion;

$$-NHR^1 \tag{II}$$

wherein $R^1$ represents a hydrogen atom, an alkyl group (e.g., methyl, ethyl), or an aralkyl group (e.g., benzyl);

$$-X^1-\underset{\underset{O}{\|}}{C}-CH_2-Y^1 \tag{III}$$

wherein $X^1$ represents a single bond or —O—; $Y^1$ represents an electron attractive group (e.g., —CN, $-COCH_3$, $-COC_6H_5$, $-SO_2CH_3$, $-SO_2CH_5$);

$$-SO_2CH{=}CH_2 \tag{IV}$$

$$-SO_2CH_2CH_2X^2 \tag{V}$$

wherein $X^2$ represents a group separating by a substitution reaction or an elimination reaction when a functional group represented by formula (V) is reacted with a nucleophilic reagent or a base (e.g., —Cl, $-OSO_2CH_3$, $-OSO_2C_6H_5CH_3$, $-OCOCH_3$, (VI)

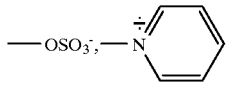

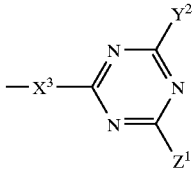

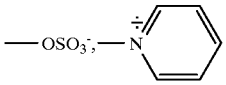

-continued

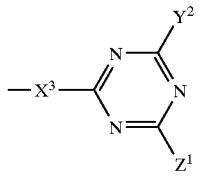

(VI)

wherein $X^3$ represents a single bond, —O— or —N($R^2$)—; $R^2$ represents a hydrogen atom, an alkyl group or an aralkyl group; $Y^2$ and $Z^1$ each represents halogen (e.g., Cl, Br), an alkoxyl group (e.g., methoxy), a hydroxyl group or salts thereof, or an amino group which may be substituted, and at least one of $Y^2$ and $Z^1$ represents halogen;

(VIII)

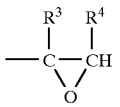

wherein $R^3$ and $R^4$ each represents a hydrogen atom or an alkyl group having from 1 to 4 carbon atoms, and $R^3$ and $R^4$ may be combined each other to form a ring;

(X)

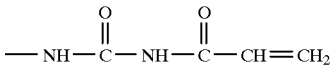

(XI)

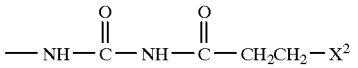

wherein $X^2$ has the same meaning as $X^2$ in formula (V);

(XII)

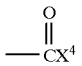

wherein $X^4$ represents a group easily separating when the functional group represented by formula (XII) is reacted with an amino group (e.g., —Cl, —O—$C_6H_4$—$NO_2$, —O—$CH_2CN$,

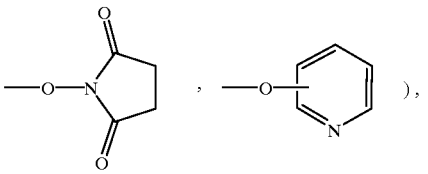

and a compound represented by formula (XII) is a compound generally known as an active ester group or a mixed acid anhydride;

—$X^5$ (XIII)

wherein $X^5$ represents Cl, Br or I;

(XIV)

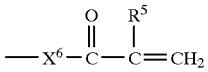

wherein $X^6$ represents a single bond, —O—, —S—or —N($R^6$)—, and $R^5$ and $R^6$ each represents a hydrogen atom or a methyl group.

There is no particular limitation on the method of introduction of functional groups which react directly or via a hardening agent with the gelatin contained in the monodispersed polymer grains for use in the present invention (e.g., groups represented by formulae (I) to (XIV), hereinafter referred to as "a reactive functional group"). Polymer grains may be produced by a polymerization reaction using monomers having the reactive functional groups, or after polymer grains are produced the above-described reactive functional groups may be introduced into the polymer grains by a polymer reaction. Further, a method of introducing reactive functional groups into a solution polymer by a polymer reaction, then forming grains, and a method of conducting a polymerization reaction using a monomer compound having a precursor of a reactive functional group, then forming a reactive functional group by an appropriate method are also effective. In the former two methods of introduction, grains may be monodispersed directly at the time of polymerization, or may be classified after polymerization. In the latter two methods of introduction, reactive functional group-containing monodispersed polymer grains can be obtained by a method of dissolving a polymer in an appropriate solvent, then monodispersed in water using an appropriate dispersant, or a method of classifying grains and monodispersed. In the present invention, it is preferred to produce polymer grains by a polymerization reaction using monomers having reactive functional groups.

The polymerization reaction in the present invention may be either a successive reaction or a chain reaction. As a successive reaction, polycondensation, polyaddition and addition condensation can be cited, and as a chain reaction, addition polymerization, isomerization polymerization, and ring-opening polymerization can be cited, and any of these methods can be used in the present invention. Further, in the latter case, any of radical, anion and cation can be used as a terminal active seed. Any method can be used as a method of polymerization initiation, for example, initiation by heat, initiation by light, initiation using a radical generator, initiation using a Lewis acid or a Lewis base, initiation by electrolysis, or initiation using oxygen.

From the viewpoint of producing monodispersed grains at the time of polymerization and introducing reactive functional groups thereto at the same time, it is preferred in the present invention to use radical addition polymers of reactive functional group-containing vinyl monomers.

Preferred examples of reactive functional group-containing vinyl monomers (hereinafter referred to as Monomer Group A) are shown below, but the present invention is not limited thereto.

Group A:
Monomer-1
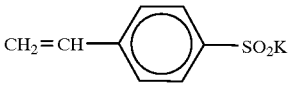
Monomer-2
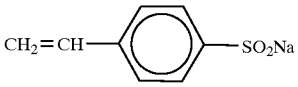
Monomer-3
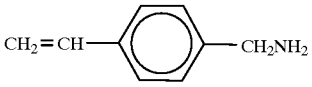
Monomer-4
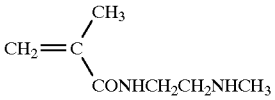
Monomer-5
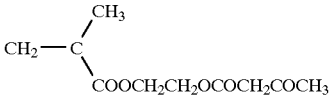
Monomer-6
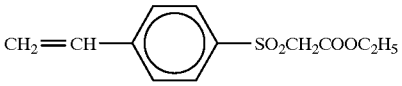
Monomer-7
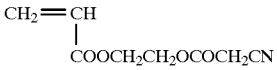
Monomer-8
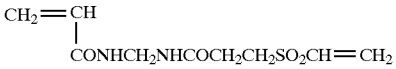
Monomer-9
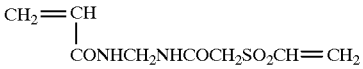
Monomer-10
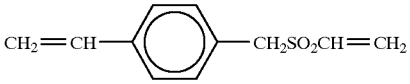
Monomer-11
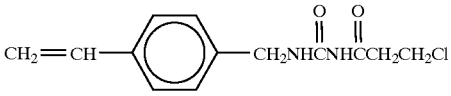
Monomer-12
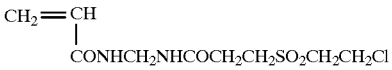

-continued
Monomer-13
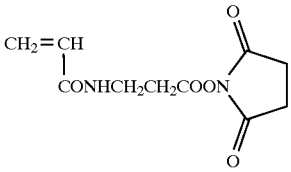
Monomer-14
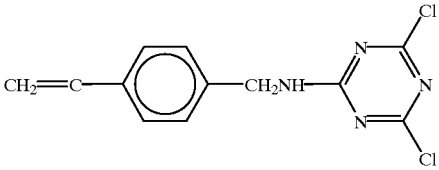
Monomer-15
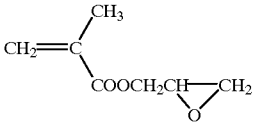
Monomer-16
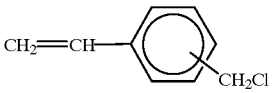
Monomer-17
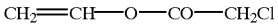
Monomer-18
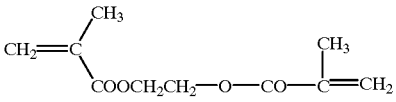
Monomer-19
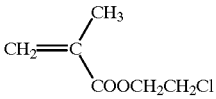
Monomer-20
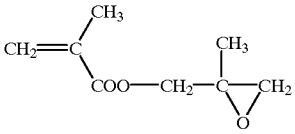
Monomer-21
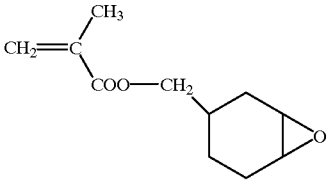

-continued

Monomer-22

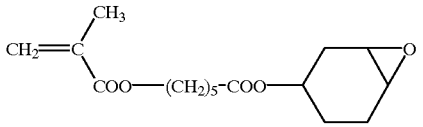

Monomer-23

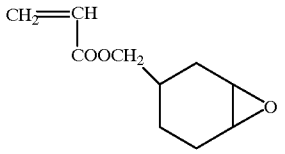

Reactive functional group-containing monomers represented by Monomer Group A may be used in combination with the following monomers (hereinafter referred to as Monomer Group B1).

Group B1:

Acrylic esters such as methyl acrylate, cyclohexyl acrylate, benzyl acrylate and phenyl acrylate, methacrylic esters such as methyl methacrylate, ethyl methacrylate, n-butyl methacrylate, isobutyl methacrylate, t-butyl methacrylate, cyclohexyl methacrylate, phenyl methacrylate and benzyl methacrylate, styrenes such as styrene, o-methylstyrene, m-methylstyrene, p-methylstyrene, α-methylstyrene, p-tert-butylstyrene and p-chlorostyrene, and vinyl halides such as vinylidene chloride, but the present invention is not limited thereto. These vinyl monomers may be used alone or in combinations with each other.

Monomers represented by Group B1 may be combined with or substituted with the following crosslinkable vinyl monomers having at least two ethylenically unsaturated groups (hereinafter referred to as Monomer Group B2).

Group B2:

Divinylbenzene, 4,4'-isopropylidenediphenylene diacrylate, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene glycol diacrylate, ethylene glycol dimethacrylate, ethylidene diacrylate, ethylidene dimethacrylate, 1,6-diacrylamido-hexane, N,N'-methylenebis-acrylamide, N,N'-(1,2-dihydroxy)-ethylenebis-acrylamide, 2,2-dimethyl-1,3-trimethylene dimethacrylate, phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, pentaerythritol triacrylate, trimethylolpropane triacrylate, tetramethylolmethane tetraacrylate, triethylene glycol dimethacrylate, 1,3,5-triacryloylhexahydro-s-triazine, bisacrylamidoacetic acid, ethylidyne trimethacrylate, propylidyne triacrylate, vinyl allyloxy acetate can be cited, but the present invention is not limited thereto. These monomers may be used in combination.

Of these, ethylene glycol dimethacrylate, divinylbenzene, N,N'-methylenebis-acrylamide, trimethylolpropane trimethacrylate, triethylene glycol dimethacrylate, tetraethylene glycol dimethacrylate, and 1,3-butanediol dimethacrylate are particularly preferred.

Further, the glass transition temperature of the polymer constituting the grains to be obtained is preferably room temperature or more and is preferred as high as possible for imparting adhesion resistance to the grains. Preferred glass transition temperature is 60° C. or more, and more preferably 80° C. or more.

Accordingly, of the vinyl monomers of Monomer Group B1 and Monomer Group B2, methyl methacrylate, styrene, and p-chlorostyrene are preferred and methyl methacrylate is particularly preferred.

Moreover, when methyl methacrylate is used in combination with other vinyl monomers, methyl methacrylate preferably accounts for 60 wt % or more.

As described above, the reactive functional group-containing vinyl monomer represented by Monomer Group A, the vinyl monomer represented by Monomer Group Bl and the vinyl monomer represented by Monomer Group B2 can be used in combination. The reactive functional group-containing vinyl monomer represented by Monomer Group A is preferably contained in an amount of from 1 wt % to 100 wt %, and particularly preferably from 5 wt % to 40 wt %.

Specific examples of polymers preferably used in the present invention are shown below, but the present invention is not limited thereto. In formulae, contents of monomers are shown in wt %.

Polymer-1

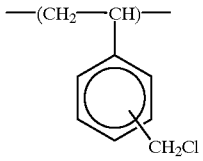

Polymer-2

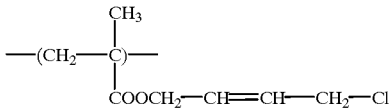

Polymer-3

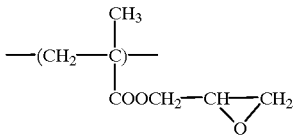

Polymer-4

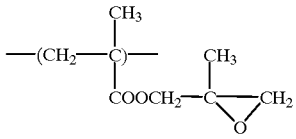

-continued
Polymer-5
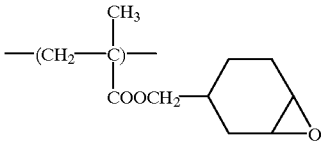
Polymer-6
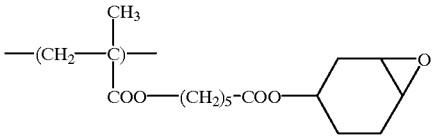
Polymer-7
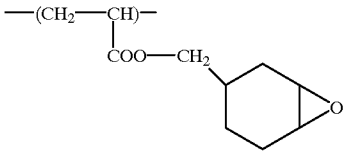
Polymer-8
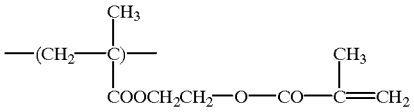
Polymer-9
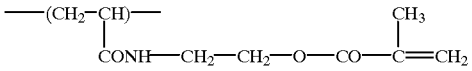
Polymer-10
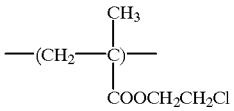
Polymer-11
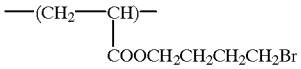
Polymer-12
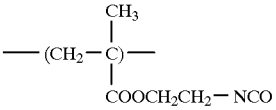
Polymer-13
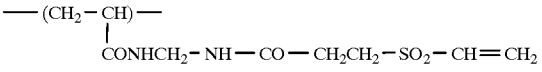
Polymer-14
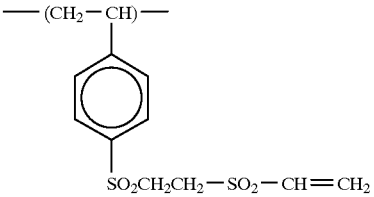
-continued
Polymer-15
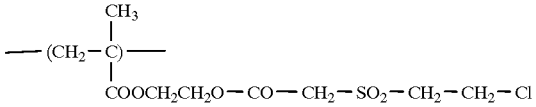
Polymer-16
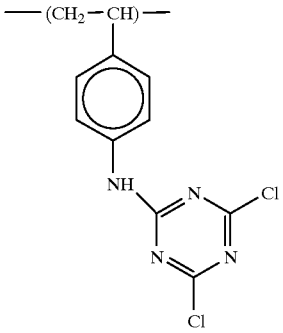
Polymer-17
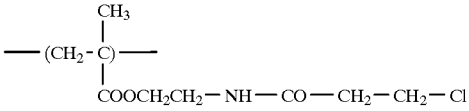
Polymer-18
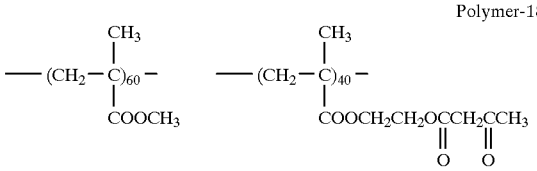
Polymer-19
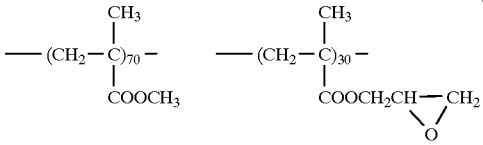
Polymer-20
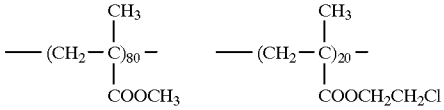
Polymer-21
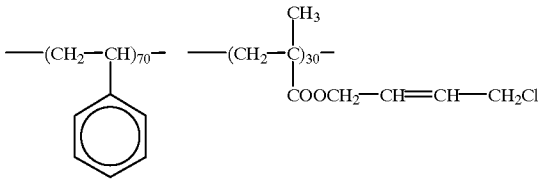
Polymer-22
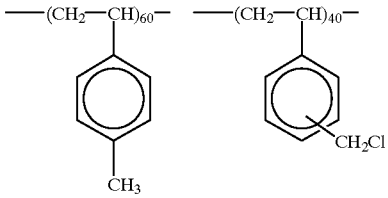

-continued
Polymer-23
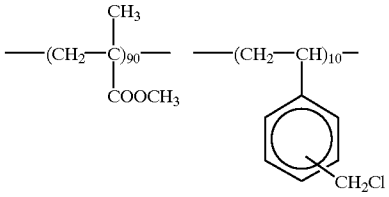
Polymer-24
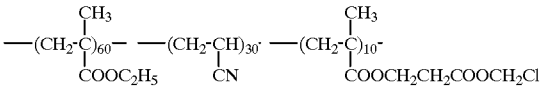
Polymer-25
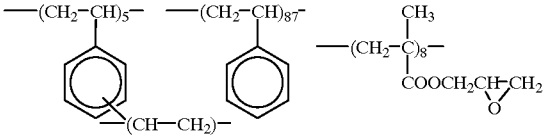
Polymer-26
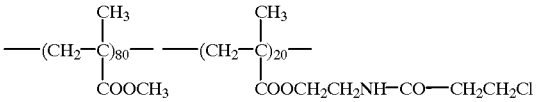
Polymer-27
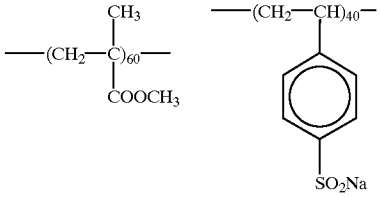
Polymer-28
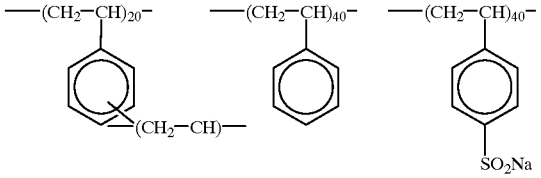
Polymer-29
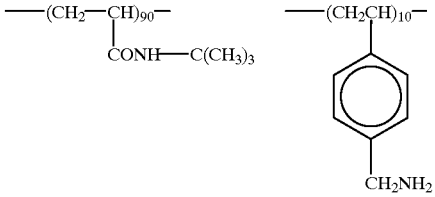
Polymer-30
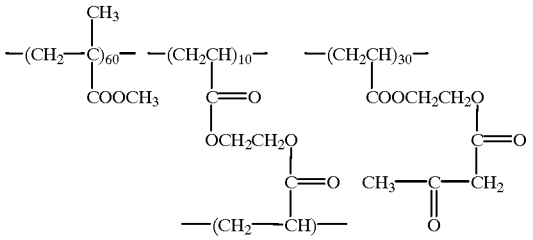
-continued
Polymer-31
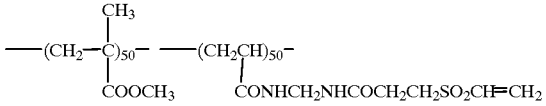
Polymer-32
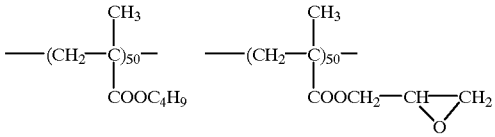
Polymer-33
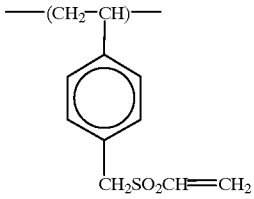
Polymer-34
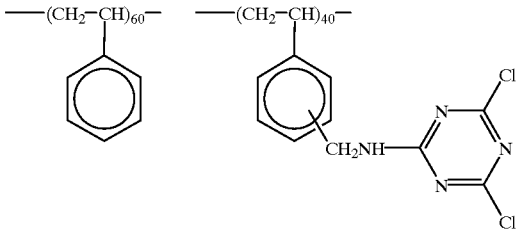
Polymer-35
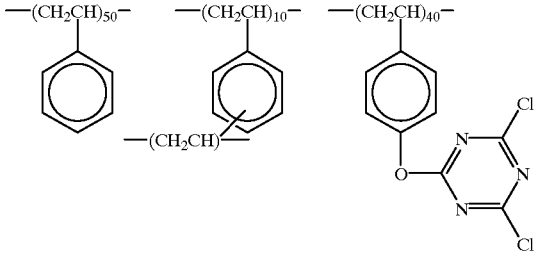
Polymer-36
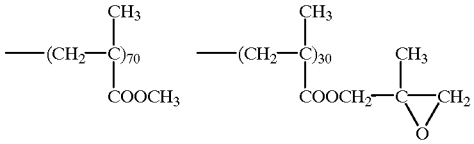
Polymer-37
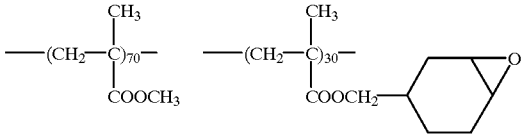

-continued

Polymer-38

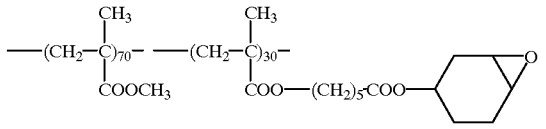

Polymer-39

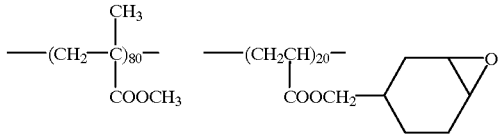

Polymer-40

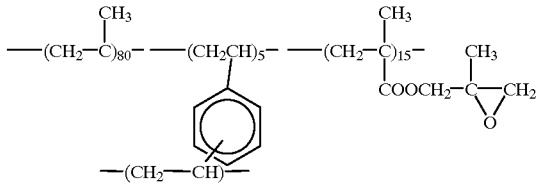

Synthesis of monodispersed grains by polymerization is described below.

Examples of monodispersion by polymerization methods include a soap free emulsion polymerization method (e.g., disclosed in *Macromol. Chem. Rapidcommun.,* 6, 315 (1985)), a suspension polymerization method (e.g., disclosed in JP-B-59-30224, JP-B-58-41464, JP-B-58-17526), a nozzle vibrating method (e.g., disclosed in *Kagaku Kogaku* (*Chemical Engineering*), 47, 540 (1983)), a swelling seed method (e.g., disclosed in U.S. Pat. No. 4,247,437), a molecular diffusion method (e.g., disclosed in *J. Polym. Sci., Polym, Letters Edition,* 21, 937 (1988)), a two stage swelling method (e.g., disclosed in *Makromol. Chem.,* 179, 815 (1978), ibid., 180, 737 (1979), U.S. Pat. No. 4,459,378, European Patent 3905), a dynamic swelling method (e.g., disclosed in *Colloid Polym. Sci.,* 269: 222–226 (1991), ibid., 270: 733–737 (1992), ibid., 270: 853–858 (1992), JP-A-1-289802, JP-A-1-299802, JP-A-1-304103, JP-A-2-6502, JP-A-2-11602, JP-A-2-11603, JP-A-2-11604, JP-A-2-11605, JP-A-2-11606, JP-A-3-237105), an accelerating diffusion polymerization method (e.g., disclosed in *Kobunshi Ronbun-Shu* (*Polymer Theses*), 50, 319 (1993)), and a dispersion polymerization method. Monodispersed polymer grains can be produced by synthesizing methods corresponding to these methods or combination of the above methods.

A dispersion polymerization method is a useful synthesizing method of polymer grains in which monodispersed grains of a micrometer size can be synthesized by one stage, which can preferably be used in the present invention. Dispersion polymerization is conducted by adding a high molecular weight dispersant to a medium in which a monomer and an initiator are soluble but a polymer to be formed is insoluble. The process of the dispersion polymerization method is described in detail in K. E. J. Barrett, *Dispersion Polymerization in Organic Media*, John Wiley & Sons.

In dispersion polymerization, the grain sizes and the distribution of grain sizes of polymer grains to be formed are largely affected by the delicate modification of setting of polymerization conditions, for example, composition of the polymerization medium, polymerization temperature, concentration of the monomer, concentration of the initiator, stirring speed, molecular weight and concentration of the dispersant. Accordingly, it is necessary to strictly control these polymerization conditions to obtain monodispersed polymer grains of a desired size. Specific controlling methods are disclosed in *Brit. Polyme. J.,* 14, 131 (1982), *J. Polym. Sci.: Part A,* 24, 2995–3007 (1986), ibid., 31, 1393–1402 (1993), JP-B-5-59924, JP-B-6-17373, JP-A-4-23805, JP-A-5-43604, JP-A-5-43605, *Kobunshi Ronbun-Shu* (*Polymer Theses*), 50, No. 4, 243–250, 251–257 (1993), and Colloid Polym. Sci., 267: 193–200 (1989).

The dispersion polymerization method of the present invention is preferably constituted of a hydrophilic organic medium, a dispersant, a vinyl monomer and an initiator. Each constituting element is described below.

First of all, a hydrophilic organic medium is an alcohol having from 1 to 6 carbon atoms, e.g., methanol, ethanol, propanol, 2-propanol, 2-methoxy-1-propanol, butanol, t-butanol, pentanol, neopentanol and cyclohexanol can be cited as preferred examples. These media may be used alone or in combination thereof, or in some cases, may be mixed with water or other organic solvents. When polymer grains containing 60 wt % or more of methyl methacrylate are to be formed, methanol, ethanol, 2-propanol are preferred as polymer media.

A dispersant has a role of adsorbing onto precipitated oligomer radicals and stabilizing to granular state, and when used in the hydrophilic organic media, homopolymers or copolymers having, as a constituting element, an ethylenically unsaturated monomer such as N-vinylpyrrolidone, acrylic acid, methacrylic acid, maleic acid, B-hydroxyethyl acrylate, β-hydroxyethyl methacrylate, vinyl alcohol, methyl vinyl ether, vinyl acetate, acrylamide, methacrylamide, diacetoneacrylamide or vinylimidazole, and polyoxyethylene, polyoxypropylene, poly-2-methyloxazoline, methyl cellulose, hydroxyethyl cellulose, or hydroxypropyl cellulose can be used as a dispersant. Preferred of these are a polyvinylpyrrolidone homopolymer, polyvinyl alcohol, polyacrylic acid and polymethacrylic acid. Molecular weight of a dispersant is preferably from 5,000 to 1,000,000 and concentration of a dispersant is preferably from 1 g/liter to 20 g/liter.

Examples of polymerization initiators which are used for vinyl monomers include azo-based initiators such as 2,2'-azobisisobutyronitrile, 2,2'-azobis(2,4-dimethylvaleronitrile), dimethyl-2,2'-azobis(2-methylpropionate), and dimethyl-2,2'-azobisisobutyrate, and peroxide initiators such as lauryl peroxide, benzoyl peroxide, and tert-butyl peroctoate.

Further, a chain transfer agent may be used in dispersion polymerization of the present invention.

Examples of preferred chain transfer agents include halogenated hydrocarbons such as carbon tetrachloride, carbon tetrabromide, ethyl acetate dibromide, ethyl acetate tribromide, ethylbenzene dibromide, ethane dibromide and ethane dichloride, hydrocarbons such as diazothioether, benzene, ethylbenzene and isopropylbenzene, mercaptans having an SH group at the terminal of an alkyl group or an alkyl group modified with various functional groups such as t-dodecylmercaptan, n-dodecylmercaptan, hexadecylmercaptan (cetylmercaptan), n-octadecylmercaptan (stearylmercaptan), and thioglycerol, sulfides such as benzyl disulfide, and thioglycolic acid derivatives such as thioglycolic acid, 2-ethylhexylthioglycolate, butylthioglycolate, methoxybutylthioglycolate, and trimethylol-propanetris (thioglycolate). When a chain transfer agent is used, the amount thereof is preferably 3 wt % or less based on the vinyl monomers.

The average grain size of the grains of the present invention is from 1 to 10 $\mu$m, preferably from 1 to 8 $\mu$m, and particularly preferably from 1 to 6 $\mu$m.

The addition amount of the grains of the present invention to one layer is preferably from 0.1 mg/m$^2$ to 200 mg/m$^2$ and more preferably from 1 mg/m$^2$ to 150 mg/m$^2$.

The grains of the present invention may be added to any layer on the emulsion layer side of the support or on the opposite side of the emulsion layer. Preferably the grains are added to the layer on the emulsion layer side and farther than the emulsion layer from the support, and the outermost layer on the opposite side of the emulsion layer of the support or the adjacent layer thereof.

The adjacent layer to the outermost layer in the present invention is not limited to only the adjacent layer to the outermost layer but means the layers in the range capable of matting the surface of the outermost layer by polymer grains of the present invention.

The layer of the photographic material in which the grains of the present invention are incorporated may be coated after inner layers of that layer from the support are coated and dried (successive coating) or may be coated at the same time with the coating of inner layers of that layer (simultaneous coating).

As the support for use in the present invention, a paper support laminated with cellulose triacetate, cellulose diacetate, nitrocellulose, polystyrene, polyethylene terephthalate, polyethylene naphthalate, syndiotactic polystyrene or polyethylene can be used. A waterproof layer containing polyvinylidene chloride based polymers may be provided on these supports for improving dimensional fluctuation due to temperature, humidity or development processing, that is, for dimensional stability.

Gelatin is used as a binder for a silver halide emulsion layer or other hydrophilic colloid layers of the present invention, but other hydrophilic colloids can also be used in combination. Examples thereof include proteins such as gelatin derivatives, graft polymers of gelatin and other high polymers, albumin and casein; sugar derivatives such as cellulose derivatives such as hydroxyethyl cellulose, carboxymethyl cellulose, methyl cellulose and cellulose sulfate, sodium alginate, and starch derivatives; and synthetic hydrophilic high polymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin can be used as well as lime-processed gelatin, and hydrolyzed product and enzyme decomposed product of gelatin can also be used.

The halide composition of the silver halide emulsion for use in the silver halide photographic material of the present invention is not particularly limited and any of silver chloride, silver chlorobromide, silver iodochlorobromide, silver bromide and silver iodobromide can be used. Silver halide grains may have any form such as a cubic, tetradecahedral or octahedral form, amorphous or plate-like form, but a cubic form is preferably used. The average grain size of the silver halide is preferably from 0.05 to 0.7 $\mu$m, more preferably from 0.08 to 0.5 $\mu$m, and grains having narrow grain size distribution, that is, variation coefficient represented by (standard deviation of grain sizes)/(average grain size) of preferably 0.15 or less, more preferably 0.10 or less are preferred.

The interior and exterior parts of the silver halide grains may comprise a uniform layer, or may comprise different layers.

Photographic emulsions for use in the present invention can be prepared according to the methods disclosed in P. Glafkides, *Chimie et Physique Photographique*, Paul Montel (1967), G. F. Duffin, *Photographic Emulsion Chemistry*, The Focal Press (1966), V. L. Zelikman, et al., *Making and Coating Photographic Emulsion*, The Focal Press (1964), and so on.

Any of a single jet method, a double jet method, and a combination of these methods can be used for reacting a soluble silver salt with a soluble halide.

Further, the so-called reverse mixing method in which silver halide grains are formed in the presence of excess silver ion can also be used. The so-called controlled double jet method, which is one form of a double jet method, in which the pAg of the liquid phase in which the silver halide is formed is maintained constant can also be used. It is also preferred to form grains using a silver halide solvent such as ammonia, tihoether, and tetra-substituted thiourea, more preferred silver halide solvent is a tetra-substituted thiourea compound and disclosed in JP-A-53-82408 and JP-A-55-77737. Preferred thiourea compounds are tetramethylthiourea and 1,3-dimethyl-2-imidazolinethione.

In the grain forming method with a controlled double jet method and a silver halide solvent, a silver halide emulsion having a regular crystal form of silver halide and a narrow distribution of grain sizes can easily be obtained, which is useful means to prepare a silver halide emulsion for use in the present invention.

To obtain a uniform grain size, it is preferred to grow grains fast within the range not exceeding the degree of critical saturation using the method of changing the addition rates of silver nitrate and alkali halide corresponding to the speed of grain growth as disclosed in British Patent 1,535,016, JP-B-48-36890 and JP-B-52-16364, or the method of changing the concentration of the aqueous solution as disclosed in U.S. Pat. No. 4,242,445 and JP-A-55-158124.

For achieving high contrast and low fog, at least one metal selected from rhodium, rhenium, ruthenium, osmium and iridium can be contained in silver halide grains for use in the silver halide photographic material of the present invention. The content thereof is preferably from $1\times10^{-9}$ to $1\times10^{-5}$, more preferably from $1\times10^{-8}$ to $5\times10^{-6}$ mol, per mol of the silver. These metals can be used in combination of two or more. These metals can be contained uniformly in silver halide grains or may be contained in the molecule provided in the grain as disclosed in JP-A-63-29603, JP-A-2-306236, JP-A-3-167545, JP-A-4-76534, and JP-A-6-110146.

A water-soluble rhodium compound can be used in the present invention. For example, a halogenated rhodium(III) compound or a rhodium complex salt having, as a ligarid, halogen, amines or oxalato, e.g., a hexachlororhodium(III) complex salt, a hexabromorhodium(III) complex salt, a hexaamminerhodium(III) complex salt, and a trioxalatorhodium(III) complex salt can be cited. These rhodium compounds are used by being dissolved in water or an appropriate solvent. For stabilizing the solution of a rhodium compound, a method generally often used, that is, a method of adding an aqueous solution of halogenated hydrogen (e.g., hydrochloric acid, hydrobromic acid, hydrofluoric acid) or alkali halide (e.g., KCl, NaCl, KBr, NaBr) to the solution can be used. It is also possible that other silver halide grains previously doped with rhodium are added and dissolved during preparation of silver halide in place of using water-soluble rhodium.

These compounds can be arbitrarily added during preparation of silver halide emulsion grains and at any stage before coating the emulsion, but they are particularly preferably added during emulsion formation and incorporated into silver halide grains.

Rhenium, ruthenium, and osmium for use in the present invention are added in the form of water-soluble complex salts as disclosed in JP-A-63-2042, JP-A-1-285941, JP-A-2-20852 and JP-A-2-20855. A particularly preferred compound is a complex having six ligands represented by the following formula:

$$[ML_6]^{-n}$$

wherein M represents Ru, Re or Os, and n represents 0, 1, 2, 3 or 4.

In this case, counter ions are not important and ammonium or alkali metal ions are used.

Examples of preferred ligands include a halide ligand, a cyanide ligand, a cyanogen oxide ligand, a nitrosyl ligand, and a thionitrosyl ligand. Specific examples of complexes for use in the present invention are shown below but the present invention is not limited thereto.

| | | |
|---|---|---|
| $[ReCl_6]^{-3}$ | $[ReBr_6]^{-3}$ | $[ReCl_5(NO]^{-2}$ |
| $[Re(NS)Br_5]^{-2}$ | $[Re(NO)(CN)_5]^{-2}$ | $[Re(O)_2(CN)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_6]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

These compounds can be arbitrarily added during preparation of silver halide emulsion grains and at any stage before coating the emulsion, but they are particularly preferably added during emulsion formation and incorporated into silver halide grains.

Various methods can be used for incorporating these compounds into silver halide grains by adding them during grain formation of silver halide, for example, a method of previously adding the aqueous solution of metal complex powders or the aqueous solution of metal complex powders dissolved therein with NaCl and KCl to a water-soluble salt or a water-soluble halide solution during grain formation, a method of adding these compounds as the third solution when a silver salt and a halide solution are added at the same time and preparing silver halide grains by a triple jet method by three solutions, or a method of adding a necessary amount of the aqueous solution of metal complexes to a reaction vessel during grain formation. A method of adding the aqueous solution of metal complex powders or the aqueous solution of metal complex powders dissolved therein with NaCl and KCl to a water-soluble halide solution is particularly preferred.

When these compounds are added to the surfaces of grains, a necessary amount of the aqueous solution of metal complexes can be added to a reaction vessel immediately after grain formation, during or at the termination of physical ripening, or during chemical ripening.

Various iridium compounds can be used in the present invention. For example, hexachloroiridium, hexaammineiridium, trioxalatoiridium, and hexacyanoiridium can be cited. These iridium compounds are used by being dissolved in water or an appropriate solvent. For stabilizing the solution of an iridium compound, a method generally often used, that is, a method of adding an aqueous solution of halogenated hydrogen (e.g., hydrochloric acid, hydrobromic acid, hydrofluoric acid) or alkali halide (e.g., KCl, NaCl, KBr, NaBr) to the solution can be used. It is also possible that other silver halide grains previously doped with iridium are added and dissolved during preparation of silver halide in place of using water-soluble iridium.

Silver halide grains in the present invention may be doped with other heavy metal salts. In particular, doping with an Fe salt such as $K_4[Fe(CN)_6]$ is advantageous.

Further, silver halide grains for use in the present invention may contain a metal atom such as cobalt, nickel, palladium, platinum, thallium, copper or lead. The addition amount of these metals is preferably $1\times10^{-9}$ to $1\times10^{-4}$ mol per mol of the silver halide. These metals can be added during grain preparation in the form of a metal salt such as a single salt, a double salt or a complex salt.

The silver halide emulsion for use in the present invention may be chemically sensitized. Conventionally known sensitizing methods such as sulfur sensitization, selenium sensitization, tellurium sensitization, reduction sensitization and noble metal sensitization can be used alone or in combination. When sensitizing methods are used in combination, for example, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually conducted by adding a sulfur sensitizer and stirring the emulsion at high temperature of 40° C. or more for a certain period of time. Various known compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfate and thiourea. The addition amount of the sulfur sensitizer is varied in accordance with various conditions such as the pH and temperature during the chemical ripening and the grain size of the silver halide, but is preferably from $10^{-7}$ to $10^{-2}$ mol and more preferably from $10^{-5}$ to $10^{-3}$ mol, per mol of the silver halide.

Various known selenium compounds can be used as a selenium sensitizer in the present invention. The selenium sensitization is usually carried out by adding unstable and/or non-stable selenium compounds and stirring the emulsion at high temperature of 40° C. or more for a certain period of time. The compounds disclosed in JP-B-44-15748, JP-B-43-13489, JP-A-4-25832, JP-A-4-109240, and JP-A-4-324855 can be used as unstable selenium compounds. The compounds disclosed in JP-A-4-324855, represented by formulae (VIII) and (IX) are particularly preferably used.

The tellurium sensitizer for use in the present invention is a compound which forms silver telluride in the surface or interior of the silver halide grains which is presumed to become a sensitization nucleus. The formation rate of the silver telluride in the silver halide emulsion can be examined according to the method disclosed in JP-A-5-313284.

Specifically, the compounds disclosed in the following patents and literature can be used as sensitizers: U.S. Pat. Nos. 1,623,499, 3,320,069, 3,772,031, British Patents 235, 211, 1,121,496, 1,295,462, 1,396,696, Canadian Patent 800, 958, JP-A-4-204640, JP-A-4-271341, JP-A-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai, *The Chemistry of Organic Selenium and Tellurium Compounds*, Vol. 1 (1986), and ibid., Vol. 2 (1987). The compounds disclosed in JP-A-5-313284, represented by formulae (II), (III) and (IV) are particularly preferred.

The amount used of the selenium and tellurium sensitizers in the present invention varies according to the silver halide grains used and the conditions of chemical ripening, but is generally about $10^{-8}$ to $10^{-2}$ mol and preferably about $10^{-7}$ to $10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

The noble metal sensitizers which are used in the present invention include gold, platinum, and palladium, and gold sensitization is particularly preferred. Specific examples of the gold sensitizers for use in the present invention include chloroauric acid, potassium chlorate, potassium aurithiocyanate and gold sulfide, and the amount of about $10^{-7}$ to $10^{-2}$ mol per mol of the silver halide can be used.

Cadmium salt, sulfite, lead salt and thallium salt may be coexist in the silver halide emulsion of the present invention in the process of formation or physical ripening of silver halide grains.

Reduction sensitization can be used in the present invention. As reduction sensitizers, stannous salt, amines, formamidinesulfinic acid, and silane compounds can be used.

Thiosulfonic acid compounds may be added to the silver halide emulsion of the present invention according to the method disclosed in European Patent 293917.

The silver halide emulsion in the photographic material of the present invention may be one kind, or two or more kinds of silver halide emulsions (for example, those differing in average grain sizes, differing in halide compositions, differing in crystal habits, differing in the conditions of chemical sensitization) may be used in combination.

The spectral sensitizing dyes for use in the present invention are not particularly limited.

The addition amount of the sensitizing dyes for use in the present invention varies according to the forms and sizes of the silver halide grains, but is used within the range of from $4\times10^{-6}$ to $8\times10^{-3}$ mol per mol of the silver halide. For example, when the silver halide grain size is from 0.2 to 1.3 $\mu$m, addition amount is preferably $2\times10^{-7}$ to $3.5\times10^{-6}$ mol, particularly preferably from $6.5\times10^{-7}$ to $2.0\times10^{-6}$ mol, per $m^2$ of the surface area of the silver halide grain.

The light-sensitive silver halide emulsion of the present invention may be spectrally sensitized using a sensitizing dye to a relatively long wavelength blue light, green light, red light and infrared light. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used.

Useful sensitizing dyes for use in the present invention are disclosed in *Research Disclosure*, Vol. 17643, Item IV-A, p. 23 (December, 1978), ibid., Vol. 1831, Item X, p. 437 (August, 1978) or the literature cited therein. In particular, sensitizing dyes having suitable sensitivity for spectral characteristics of various scanner light sources can be advantageously selected.

For example, A) For an argon laser light source, simple merocyanines disclosed in JP-A-60-162247, JP-A-2-48653, U.S. Pat. No. 2,161,331, West German Patent 936,071 and JP-A-5-11389, B) for a helium-neon laser light source, trinuclear cyanine dyes disclosed in JP-A-50-62425, JP-A-54-18726 and JP-A-59-102229, C) for an LED light source and red semiconductor laser, thiacarbocyanines disclosed in JP-B-48-42172, JP-B-51-9609, JP-B-55-39818, JP-A-62-284343 and JP-A-44 -2-105135, and D) for an infrared semiconductor laser light source, tricarbocyanines disclosed in JP-A-59-191032 and JP-A-60-80841, and dicarbocyanines having a 4-quinoline nucleus disclosed in JP-A-59-192242 and formulae (IIIa) and (IIIb) of JP-A-3-67242 can be advantageously selected.

These sensitizing dyes may be used either alone or in combination thereof. A combination of sensitizing dyes is often used particularly for the purpose of supersensitization. There may be contained in an emulsion together with sensitizing dyes, a dye having no spectral sensitizing action by itself or a material which does not substantially absorb visible light but shows supersensitization.

A combination of useful sensitizing dyes and dyes showing supersensitization and materials showing supersensitization are disclosed in *Research Disclosure* Vol. 176, No. 17643, p. 23, Item IV-J (December, 1978).

There is no particular limitation on the developing agent of the developing solution for use in the present invention, but it is preferred to include dihydroxybenzenes because good dot quality is easily obtained and in some cases a combination of dihydroxybenzenes and 1-phenyl-3-pyrazolidones, or a combination of dihydroxybenzenes and p-aminophenols is used.

Further, ascorbic acids are also preferably used as a developing agent.

Specific examples of dihydroxybenzene developing agents for use in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, and hydroquinone is particularly preferred of them.

Examples of 1-phenyl-3-pyrazolidones or derivatives thereof for use in the present invention as a developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Examples of p-aminophenol developing agents for use in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzyl-aminophenol, and N-methyl-p-aminophenol is preferred of these.

A developing agent is in general preferably used in an amount of from 0.05 mol/liter to 0.8 mol/liter. When a combination of dihydroxybenzenes with 1-phenyl-3-pyrazolidones or with p-aminophenols is used, the former is preferably used in an amount of from 0.05 mol/liter to 0.5 mol/liter, and the latter is preferably used in an amount of 0.06 mol/liter or less.

Sulfite preservatives for use in the present invention include sodium sulfite, potassium sulfite, lithium sulfite, ammonium sulfite, sodium bisulfite, potassium metabisulfite, and sodium formaldehyde bisulfite. Sulfite is used in an amount of 0.3 mol/liter or more, particularly 0.4 mol/liter or more is preferred. The upper limit of the addition amount is 2.5 mol/liter and, in particular, up to 1.2 mol/liter is preferred. When dihydroxybenzenes are used as a developing agent, ascorbic acids are preferably used as a preservative and the addition amount is from 0.03 to 0.12 in mol ratio based on the developing agent.

An alkali agent for setting pH includes a pH adjustor or a buffer such as sodium hydroxide, potassium hydroxide, sodium carbonate, potassium carbonate, sodium tertiary phosphate, potassium tertiary phosphate, sodium silicate, and potassium silicate.

The pH of the developing solution for use in the development processing of the present invention is preferably from 9.0 to 12.5. When pH is 11 or more, the fluctuation with the lapse of time of the developing solution is deteriorated and is not preferred, while when it is 9.0 or less, sufficient contrast cannot be obtained. pH is more preferably within the range of from 9.8 to 12.0.

Additives which can be used in addition to the above compounds include a compound such as boric acid and borax, a development inhibitor such as sodium bromide, potassium bromide and potassium iodide; an organic solvent such as ethylene glycol, diethylene glycol, triethylene glycol, dimethylformamide, methyl cellosolve, hexylene glycol, ethanol and methanol; and an antifoggant such as a mercapto compound, e.g., 1-phenyl-5-mercaptotetrazole, and sodium 2-mercaptobenzimidazole-5-sulfonate, an indazole compound, e.g., 5-nitroindazole, and a benzotriazole compound, e.g., 5-methylbenzotriazole. Further, if necessary, a color toner, a surfactant, a defoaming agent, a hard water softener, and a hardening agent may be contained. In particular, the amino compounds disclosed in JP-A-56-106244 and the imidazole compounds disclosed in JP-B-48-35493 are preferred from development acceleration or sensitivity increase. The developing solution for use in the present invention can contain the compounds disclosed in JP-A-56-24347 and JP-A-4-362942 as a silver stain inhibitor, the compounds disclosed in JP-A-62-212651 as a development unevenness inhibitor, and the compounds disclosed in JP-A-61-267759 as a dissolution aid.

The developing solution for use in the present invention contains the boric acid disclosed in JP-A-62-186259, the sugars (e.g., sucrose) disclosed in JP-A-60-93433, oximes (e.g., acetoxime), phenols (e.g., 5-sulfosalicylic acid) and tertiary phosphate (e.g., sodium salt, potassium salt) as a buffer, and boric acid is preferred.

A fixing solution is an aqueous solution which contains, if necessary, a hardening agent (e.g., a water-soluble aluminum compound) and acetic acid and dibasic acid (e.g., tartaric acid, citric acid, and the salts thereof), in addition to the fixing agent, and preferably has pH of 3.8 or more, more preferably from 4.0 to 5.5. The fixing agent includes sodium thiosulfate and ammonium thiosulfate, and ammonium thiosulfate is particularly preferred in terms of fixing speed. The amount used of the fixing agent can arbitrarily be changed, and in general, it is from about 0.1 to about 5 mol/liter.

The water-soluble aluminum compound which acts primarily as a hardening agent in the fixing solution is a compound which is generally known as the hardening agent for an acidic hardening fixing solution, and it includes, for example, aluminum chloride, aluminum sulfate, and potassium alum.

Tartaric acid or the derivative thereof and citric acid or the derivative thereof can be used alone or in combination of two or more as the above dibasic acid. These compounds are effective to be contained in an amount of 0.005 mol or more per liter of the fixing solution, and from 0.01 to 0.03 mol/liter is particularly effective.

Specific examples thereof include tartaric acid, potassium tartrate, sodium tartrate, potassium sodium tartrate, ammonium tartrate, and ammonium potassium tartrate.

Examples of citric acid or the derivative thereof effective in the present invention include citric acid, sodium citrate, and potassium citrate.

The fixing solution further contains, if required, a preservative (e.g., sulfite, bisulfite), a pH buffer (e.g., acetic acid, boric acid), a pH adjustor (e.g., ammonia, sulfuric acid), an image preservation improver (e.g., potassium iodide), and a chelating agent. The pH buffer is used in an amount of preferably from 10 to 40 g/liter, more preferably from 18 to 25 g/liter since pH of a developing solution is high.

The fixing temperature and time are the same as the development and are preferably from about 20° C. to about 50° C. and from 10 seconds to 1 minute, respectively.

Washing water may contain an antifungal agent (for example, the compounds described in Horiguchi, Bohkin Bohbai no Kagaku (Antibacterial and Antifungal Chemistry), and JP-A-62-115154), a washing accelerator (e.g., sulfite), and a chelating agent.

According to the above processes, a photographic material developed and fixed is washed and dried. Washing is conducted in order to almost completely remove a silver salt dissolved by fixing and carried out preferably at about 20° C. to about 50° C for from 10 seconds to 3 minutes. Drying is conducted at about 40° C. to about 100° C. The drying time is arbitrarily changed according to environmental conditions and is usually sufficient for about 5 seconds to 3 minutes.

A roller transporting type automatic developing machine is disclosed in U.S. Pat. Nos. 3,025,779 and 3,545,971, and is referred to simply as a roller transporting type processor in the present specification. The roller transporting type processor consists of the four steps of developing, fixing, washing and drying. In the present invention, other steps (for example, a stopping step) are not excluded but these four steps are most preferably followed. Water can be saved by employing a countercurrent system of 2 or 3 stages in washing step.

The developing solutions for use in the present invention are preferably preserved in the packaging materials of low oxygen permeation as disclosed in JP-A-61-73147. Further, the replenishing system disclosed in JP-A-62-91939 is preferably used in the developing solutions for use in the present invention.

There are no particular limitations on various additives and development processing methods for use in the photographic material of the present invention, for example, those described in the following places can be preferably used.

| Item | | Places |
|---|---|---|
| 1) | Hydrazine nucleating agent | line 19, right upper column, page 2 to line 3, right upper column, page 7 of JP-A-2-12236; and formula (II) and Compounds II-1 to II-54 in line 1, right lower column, page 20 to line 20, right upper column, page 27 of JP-A-3-174143 |
| 2) | Nucleation accelerating agent | formulae (II-m) to (II-p) and Compounds II-1 to II-22 in line 13, right upper column, page 9 to line 10, left upper column, page 16 of JP-A-2-103536; and the compounds disclosed in JP-A-1-179939 |
| 3) | Silver halide emulsion and the preparation method | line 12, right lower column, page 20 to line 14, left lower column, page 21 of JP-A-2-97937; line 19, right upper column, page 7 to line 12, left lower column, page 8 of JP-A-2-12236; and the selenium sensitization method in JP-A-5-11389 |
| 4) | Spectral sensitizing dye | line 13, left lower column, page 8 to line 4, right lower column, page 8 of JP-A-2-12236; line 3, right lower column, page 16 to line 20, left lower column, page 17 of JP-A-2-103536; line 8, left upper column, page 7 to line 8, right lower column, page 8 of JP-A-2-55349; line 8, right lower column, page 7 to line 5, right lower column, page 13 of JP-A-2 39042; and the spectral sensitizing dyes in JP-A-1-112235, JP-A-2-124560, JP-A-3-7928, JP-A-5-11389 |
| 5) | Surfactant | line 7, right upper column, page 9 to line 7, right lower column, page 9 of JP-A-2-12236; and line 13, left lower column, page 2 to line 18, right lower column, page 4 of JP-A-2-18542; |
| 6) | Antifoggant | line 19, right lower column, page 17 to line 4, right upper column, page 18 of JP-A-2-103536; lines 1 to 5, right lower column, page 18 of JP-A-2-103536; and the thiosulfinic acid compounds in JP-A-1-237538 |
| 7) | Polymer latex | lines 12 to 20, left lower column, page 18 of JP-A-2-103536 |
| 8) | Compound having acid radical | line 6, right lower column, page 18 to line 1, left upper column, page 19 of JP-A-2-103536 |
| 9) | Matting agent, sliding agent and plasticizer | line 15, left upper column, page 19 to line 15, right upper column, page 19 of JP-A-2-103536 |
| 10) | Hardening agent | lines 5 to 17, right upper column, page 18 of JP-A-2-103536 |
| 11) | Dye | lines 1 to 18, right lower column, page 17 of JP-A-2-103536; and the solid dyes in JP-A-2-294638 and JP-A-5-11382 |
| 12) | Binder | lines 1 to 20, right lower column, page 3 of JP-A-2-18542 |
| 13) | Black pepper inhibitor | the compounds in U.S. Patent 4,956,257 and JP-A-1-118832 |
| 14) | Redox compound | the compounds represented by formula (I) (in particular, Compounds 1 to 50) in JP-A-2-301743; formulae (R-1), (R-2) and |

-continued

| Item | | Places |
|---|---|---|
| | | (R-3), Compounds 1 to 75 on pages 3 to 20 in JP-A-3-174143; and the compounds in JP-A-5-257239 and JP-A-4-278939 |
| 15) | Monomethine compound | The compounds represented by formula (II) (in particular, Compounds II-1 to II-26) in JP-A-2-287532 |
| 16) | Dihydroxybenzenes | the disclosure from left upper column, page 11 to left lower column, page 12 in JP-A-3-39948; and the compounds in EP-A-452772 |
| 17) | Developing solution and developing method | line 16, right upper column, page 19 to line 8, left upper column, page 21 in JP-A-2-103536 |
| 18) | Tetrazolium compound | line 8, left lower column, page 4 to line 6, left lower column, page 6 in JP-A-2-29143; and line 19, right upper column, page 3 to line 20, left upper column, page 5 in JP-A-3-123346 |

The present invention can also be applied to a color photographic material. A color photographic material comprises a unit light-sensitive layer having a spectral sensitivity to any of blue light, green light and red light. In a multilayer silver halide color photographic material, these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivities, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer.

Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halides preferably used in the present invention are silver iodobromide, silver iodochloride or silver iodochlorobromide containing about 30 mol % or less of silver iodide, and particularly preferably used are silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twinned crystal planes, or a form which is a composite of these forms.

The silver halide grains may be a fine grain having a grain size of about 0.2 $\mu$m or less, or large size grains having a projected area diameter of up to about 10 $\mu$m, and the emulsion may be a polydispersed emulsion or a monodispersed emulsion.

The silver halide photographic emulsions for use in the present invention can be prepared using the methods disclosed, for example, in *Research Disclosure* (hereinafter abbreviated to RD), No. 17643, pages 22 and 23 (December, 1978), "I. Emulsion Preparation and Types", *RD*, No. 18716, page 648 (November, 1979), *RD*, No. 307105, pages 863 to 865 (November, 1989), P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodispersed emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halide compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the surface latent image type wherein the latent image is primarily formed on the surface, or of the internal latent image type wherein the latent image is formed within the grains, or of a type wherein the latent image is formed both at the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process and the like, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in *RD*, No. 17643, *RD*, No. 18716, and *RD*, No. 307105, and the locations of these disclosures are summarized in a table below.

In the photographic material of the present invention, two or more different types of emulsions which are different in terms of at least one of the characteristics of grain size, grain size distribution, halide composition, form of the grains, or sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halide compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 $\mu$m, and particularly preferably from 0.05 to 0.6 $\mu$m. Further, the form of the grains may be regular grains and may be a polydispersed emulsion, but a monodispersed emulsion (at least 95% of which have a grain size within ±40% of the average grain size in terms of the weight or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining dye images and which do not substantially undergo development during development processing, and they are preferably not pre-fogged. The fine grained silver halide has a silver bromide content of from 0 to 100 mol %, and may contain silver chloride and/or silver iodide, if necessary. The fine grained silver halides which have a silver iodide content of from 0.5 to 10 mol % are preferred. The average grain size of the fine grained silver halide (the average value of the diameters of the circles corresponding to the projected areas) is preferably from 0.01 to 0.5 $\mu$m, more preferably from 0.02 to 0.2 $\mu$m.

The fine grained silver halide can be prepared by the same methods as the preparation of generally used light-sensitive silver halides. In the preparation of the fine grained silver halide, the surface of the silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in the fine grained silver halide before addition to the coating solution. Colloidal silver can be included in the layer containing the fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in *RD* and the locations related thereto are indicated in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbing Agents, Filter Dyes, and Ultraviolet Absorbing Agents | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the present invention, and the following couplers are particularly preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), column 7, lines 36 to 58 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; [A-4]-63 (page 134), and [A-4]-73 to [A-4]-75 (page 139) of European Patent 456257; M-4 to M-6 (page 26) and M-7 (page 27) of European Patent 486965; M-45 (page 19) of EP-A-571959; (M-1) (page 6) of JP-A-5-204106; and M-22, paragraph 0237 of JP-A-4-362631.

Cyan Couplers:

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17)

(pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the colored dyes of which have an appropriate diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for correcting the unnecessary absorption of colored dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development inhibitor releasing compounds:

The compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58);

The compounds represented by formula (I) disclosed on page 7 of EP-A-436938 (in particular, D-49 (page 51));

The compounds represented by formula (1) disclosed in EP-A-568037 (in particular, (23) (page 11); and The compounds represented by formula (I), (II) or (III) disclosed on pages 5 and 6 of EP-A-440195 (in particular, I-(1) on page 29);

Bleaching accelerator releasing compounds:

The compounds represented by formula (I) or (I') disclosed on page 5 of EP-A-310125 (in particular, (60) and (61) on page 61); and The compounds represented by formula (I) disclosed in claim 1 of JP-A-6-59411 (in particular, (7) on page 7);

Ligand releasing compounds:

The compounds represented by LIG-X disclosed in claim 1 of U.S. Pat. No. 4,555,478 (in particular, the compounds in lines 21 to 41, column 12);

Leuco dye releasing compounds:

Compounds 1 to 6, columns 3 to 8 of U.S. Pat. No. 4,749,641;

Fluorescent dye releasing compounds:

The compounds represented by COUP-DYE disclosed in claim 1 of U.S. Pat. No. 4,774,181 (in particular, compounds 1 to 11, columns 7 to 10);

Development accelerator releasing or fogging agent releasing compounds:

The compounds represented by formula (1), (2) or (3), column 3 of U.S. Pat. No. 4,656,123 (in particular, (I-22), column 25); and Compound ExZK-2, lines 36 to 38, page 75 of EP-A-450637; and Compounds which release dyes the color of which is restored after elimination:

The compounds represented by formula (I) disclosed in claim 1 of U.S. Pat. No. 4,857,447 (in particular, Y-1 to Y-19, columns 25 to 36).

Preferred additives other than couplers are listed below:

Dispersion mediums of oil-soluble organic compound:

P-3, P-5, P-16, P-19, P-25, P-30, P-42, P-49, P-54, P-55, P-66, P-81, P-85, P-86 and P-93 (pages 140 to 144) of JP-A-62-215272;

Latexes for impregnation of oil-soluble organic compound:

The latexes disclosed in U.S. Pat. No. 4,199,363;

Scavengers for the oxidation product of a developing agent:

The compounds represented by formula (I), lines 54 to 62, column 2 of U.S. Pat. No. 4,978,606 (in particular, I-(1), I-(2), I-(6) and I-(12), columns 4 and 5), and The compounds represented by the formula disclosed in lines 5 to 10, column 2 of U.S. Pat. No. 4,923,787 (in particular, compound 1, column 3);

Stain inhibitors:

The compounds represented by formula (I), (II) or (III), lines 30 to 33, page 4 of EP-A-298321 (in particular, I-47, I-72, III-1 and III-27, pages 24 to 48);

Discoloration inhibitors:

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321, II-1 to III-23, columns 25 to 38 of U.S. Pat. No. 5,122,444 (in particular, III-10), I-1 to III-4, pages 8 to 12 of EP-A-471347 (in particular, II-2), and A-1 to A-48, columns 32 to 40 of U.S. Pat. No. 5,139,931 (in particular, A-39 and A-42);

Compounds for reducing the using amounts of color intensifiers and color mixing preventives:

I-i to II-15, pages 5 to 24 of EP-A-411324 (in particular, I-46);

Formaldehyde scavengers:

SCV-1 to SCV-28, pages 24 to 29 of EP-A-477932 (in particular, SCV-8);

Hardening agents:

H-1, H-4, H-6, H-8 and H-14 on page 17 of JP-A-1-214845,

The compounds represented by any of formulae (VII) to (XII), columns 13 to 23 of U.S. Pat. No. 4,618,573 (H-1 to H-54), The compounds represented by formula (6), right lower column, page 8 of JP-A-2-214852 (H-1 to H-76) (in particular, H-14), and The compounds disclosed in claim 1 of U.S. Pat. No. 3,325,287;

Development inhibitor precursors:

P-24, P-37 and P-39, pages 6 and 7 of JP-A-62-168139, and

The compounds disclosed in claim 1 of U.S. Pat. No. 5,019,492 (in particular, compounds 28 and 29, column 7);

Fungicides and biocides:

I-1 to III-43, columns 3 to 15 of U.S. Pat. No. 4,923,790 (in particular, II-1, II-9, II-10, II-18 and III-25);

Stabilizers and antifoggants:

I-1 to (14), columns 6 to 16 of U.S. Pat. No. 4,923,793 (in particular, I-1, 60, (2) and (13)); and Compounds 1 to 65, columns 25 to 32 of U.S. Pat. No. 4,952,483 (in particular, compound 36);

Chemical sensitizers:

Triphenylphosphine selenide, and

Compound 50 disclosed in JP-A-5-40324;

Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450, F-I-1 to F-II-43, pages 33 to 55 of EP-A-445627 (in particular, F-I-11 and F-II-8), III-1 to III-36, pages 17 to 28 of EP-A-457153 (in particular, III-1 and III-3), Crystallite dispersions of Dye-1 to Dye-124, pages 8 to 26 of WO 88/04794, Compounds 1 to 22, pages 6 to 11 of EP-A-319999 (in particular, compound 1), Compounds D-1 to D-87 represented by any of formulae (1) to (3), pages 3 to 28 of EP-A-519306, Compounds 1 to 22 represented by formula (I), columns 3 to 10 of U.S. Pat. No. 4,268,622, and Compounds (1) to (31) represented by formula (I), columns 2 to 9 of U.S. Pat. No. 4,923,788;

Ultraviolet absorbing agents:

Compounds (18b) to (18r) represented by formula (1), 101 to 427, pages 6 to 9 of JP-A-46-3335, Compounds (3) to (66) represented by formula (I), pages 10 to 44, and compounds HBT-1 to HBT-10 represented by formula (III), page 14, of EP-A-520938, and Compounds (1) to (31) represented by formula (1), columns 2 to 9 of EP-A-521823.

The present invention can be applied to various color photographic materials such as color negative films for general and cinematographic uses, color reversal films for slide and television uses, color papers, color positive films and color reversal papers. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in *RD*, No. 17643, page 28, *RD*, No. 18716, from page 647, right column to page 648, left column, and *RD*, No. 307105, page 879.

The photographic material of the present invention has a total film thickness of all the hydrophilic colloid layers on the side where the silver halide emulsion layers are located of preferably 28 μm or less, more preferably 23 μm or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% relative humidity (stored for 2 days), and $T_{1/2}$ can be measured using a swellometer of the type described in A. Green, *Photoqr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness.

The provision of hydrophilic colloid layers (known as backing layers) having a total dry film thickness of from 2 μm to 20 μm on the side of the support opposite to the side on which emulsion layers are provided is preferred in the photographic material of the present invention. The inclusion of the above described light absorbing agents, filter dyes, ultraviolet absorbing agents, antistatic agents, hardening agents, binders, plasticizers, lubricants, coating aids, and surfactants in the backing layers is preferred. The swelling factor of the backing layer is preferably from 150 to 500%.

The photographic material of the present invention can be development processed by the ordinary methods disclosed in *RD*, No. 17643, pages 28 and 29, *RD*, No. 18716, page 651, from left column to right column, and *RD*, No. 307105, pages 880 and 881.

The processing solutions for a color negative film for use in the present invention are described below.

The color developing solution for use in the present invention can contain the compounds disclosed in line 1, right upper column, page 9 to line 4, left lower column, page 11 of JP-A-4-121739. In particular, when carrying out rapid processing, 2-methyl-4-[N-ethyl-N-(2-hydroxyethyl) amino]-aniline, 2-methyl-4-[N-ethyl-N-(3-hydroxypropyl) amino]-aniline, and 2-methyl-4-[N-ethyl-N-(4-hydroxybutyl)amino]-aniline are preferably used as color developing agents.

These color developing agents are contained in a color developing solution preferably in an amount of from 0.01 to 0.08 mol, more preferably from 0.015 to 0.06 mol, and still more preferably from 0.02 to 0.05 mol, per liter of the color developing solution. In the replenisher of the color developing solution, these color developing agents are preferably contained from 1.1 to 3 times, in particular, from 1.3 to 2.5 times, of the above concentration.

As hydroxylamine can be widely used as a preservative of a color developing solution, when higher preservability is required, hydroxylamine derivatives having an alkyl group, a hydroxyalkyl group, a sulfoalkyl group or a carboxyalkyl group as a substituent are preferred. Specifically, N,N-di (sulfoethyl)hydroxylamine, monomethylhydroxylamine, dimethylhydroxylamine, monoethylhydroxylamine, diethylhydroxylamine, and N,N-di(carboxyethyl) hydroxylamine are preferably used. N,N-di(sulfoethyl) hydroxylamine is particularly preferred of the above. These compounds can be used in combination with hydroxylamine, but they are preferably used in combination of one or two or more in place of hydroxylamine.

A preservative is preferably used in an amount of from 0.02 to 0.2 mol, more preferably from 0.03 to 0.15 mol, and still more preferably from 0.04 to 0.1 mol, per liter of the color developing solution. In the replenisher, same as in the color developing agent, a preservative is preferably contained in the concentration of from 1.1 to 3 times of the mother solution (processing tank solution).

In a color developing solution, sulfite is used to prevent the oxidized product of a color developing agent from becoming tar. The concentration of sulfite in a color developing solution is preferably from 0.01 to 0.05 mol, particularly preferably from 0.02 to 0.04 mol, per liter of the color developing solution. In the replenisher, it is preferred to use sulfite in the concentration of from 1.1 to 3 times of these amounts.

The pH of a color developing solution is preferably from 9.8 to 11.0, and particularly preferably from 10.0 to 10.5, and pH of the replenisher is preferably set at the value by 0.1 to 1.0 higher than the above value. Known pH buffers such as carbonate, phosphate, sulfosalicylate, and borate are used for stably maintaining the pH.

The replenishment rate of a color developing solution is preferably from 80 to 1,300 ml per $m^2$ of the photographic material but, the less is the better, from the viewpoint of the reduction of environmental pollution, and is generally from 80 to 600 ml, preferably from 80 to 400 ml.

The concentration of bromide ion in a color developing solution is generally from 0.01 to 0.06 mol/liter but for purposes of preventing the generation of fog and improving the discrimination while maintaining sensitivity and, further, improving graininess, it is preferred to set the concentration from 0.015 to 0.03 mol/liter. When the concentration of bromide ion is defined in such a range, the concentration of bromide ion in the replenisher can be obtained from the following equation, however, when C is minus, bromide ion is preferably not contained in the replenisher.

$$C=A-W/V$$

C: The concentration of bromide ion in the replenisher of the color developing solution (mol/liter)

A: The concentration of bromide ion in the objective color developing solution (mol/liter)

W: The amount of bromide ion dissolved out from the photographic material into the color developing solution when $m^2$ of the photographic material is color developed (mol)

V: The replenishment rate of the color developing replenisher per $m^2$ of the photographic material (liter)

Moreover, when the replenishment rate is reduced or bromide ion is set in a high concentration, as a method of increasing sensitivity, pyrazolidones such as 1-phenyl-3-pyrazolidone and 1-phenyl-2-methyl-2-hydroxymethyl-3-pyrazolidone, and thioether compounds such as 3,6-dithia-1,8-octanediol are preferably used as a development accelerator.

The compounds and the processing conditions disclosed in line 16, left lower column, page 4 to line 6, left lower column, page 7 of JP-A-4-125558 can be applied to the processing solution having a bleaching ability of the present invention.

A bleaching agent having an oxidation reduction potential of 150 mV or more is preferred, and specific examples thereof disclosed in JP-A-5-72694 and JP-A-5-173312 are preferably used in the present invention, in particular, 1,3-diaminopropanetetraacetic acid and the ferric complex salt of the compounds in specific example 1, page 7 of JP-A-5-173312 are preferred.

In addition, for improving the biodegradability of a bleaching agent, it is preferred to use the ferric complex salt of the compounds disclosed in JP-A-4-251845, JP-A-4-268552, European Patents 588289, 591934, and JP-A-6-208213 as a bleaching agent. The concentration of these bleaching agents is preferably from 0.05 to 0.3 mol per liter of the processing solution having a bleaching ability, and for reducing the discharge amount to the environment, the concentration from 0.1 to 0.15 mol per liter is preferred. When the solution having a bleaching ability is a bleaching solution, it is preferred to contain bromide in an amount of from 0.2 to 1 mol, and particularly preferably from 0.3 to 0.8 mol, per liter of the bleaching solution.

The replenisher of the solution having a bleaching ability contains fundamentally the concentration of each component calculated by the following equation. According to this, the concentration in the mother solution can be maintained constant.

$$C_R = C_T \times (V_1 + V_2)/V_1 + C_P$$

$C_R$: The concentration of the component in the replenisher $C_T$: The concentration of the component in the mother solution (processing tank solution)

$C_P$: The concentration of the component consumed during processing $V_1$: The replenishment rate of the replenisher having a bleaching ability per $m^2$ of the photographic material (ml)

$V_2$: The amount of carryover from the previous tank by $m^2$ of the photographic material (ml)

In addition, a bleaching solution preferably contains a pH buffer, in particular, comparatively odorless dicarboxylic acids such as succinic acid, maleic acid, malonic acid, glutaric acid, and adipic acid are preferred. It is also preferred to use the known bleaching accelerators disclosed in JP-A-53-95630, (RD), No. 17129, and U.S. Pat. No. 3,893,858.

A bleaching solution is preferably replenished with a bleaching replenisher in an amount of from 50 to 1,000 ml per $m^2$ of the photographic material, more preferably from 80 to 500 ml and most preferably from 100 to 300 ml. Further, a bleaching solution is preferably conducted aeration.

The compounds and the processing conditions disclosed in line 10, left lower column, page 7 to line 19, right lower column, page 8 of JP-A-4-125558 can be applied to the processing solution having a fixing ability.

In particular, for improving fixing speed and preservability, the compounds represented by formulae (I) and (II) disclosed in JP-A-6-301169 are preferably added to the processing solution having a fixing ability alone or in combination. Further, the use of the sulfinic acid disclosed in JP-A-1-224762 as well as p-toluenesulfinate is preferred for improving preservability.

In the solution having a bleaching ability and the solution having a fixing ability, ammonium is preferably used as a cation for improving a desilvering ability but taking the reduction of the environmental pollution into consideration, ammonium is preferably reduced or, if possible, not contained at all.

In bleaching, bleach-fixing and fixing processes, it is particularly preferred to carry out the jet stirring as disclosed in JP-A-1-309059.

The replenishment rate of the replenisher in bleach-fixing process or fixing process is from 100 to 1,000 ml, preferably from 150 to 700 ml, and particularly preferably from 200 to 600 ml, per $m^2$ of the photographic material, It is preferred to recover silver by installing various silver recovery devices by in-line and off-line systems in bleach-fixing and fixing processes. Using an in-line system, processing can be carried out with a reduced concentration of silver in a solution, as a result, the replenishment rate can be reduced. Further, it is preferred to recover silver by an off-line system and reuse the solution after silver recovery as a replenisher.

Bleach-fixing process and fixing process may comprise a plurality of processing tanks and it is preferred to adopt a multistage countercurrent system with each tank being arranged in cascade piping. From the balance with the size of a processor, in general, two-tank cascade structure is effective and the proportion of the processing time in the preceding tank and the succeeding tank is preferably from 0.5/1 to 1/0.5, particularly preferably from 0.8/1 to 1/0.8.

From the viewpoint of improving preservability, it is preferred that a free chelating agent not in the form of a metal complex is contained in a bleach-fixing solution or a fixing solution, and the biodegradable chelating agent described above with respect to the bleaching solution is preferably used as such a chelating agent.

With respect to washing and stabilizing processes, the contents disclosed in line 6, right lower column, page 12 to line 16, right lower column, page 13 of the above JP-A-4-125558 can be preferably applied to the present invention. In particular, the use of the azolylmethylamines disclosed in European Patents 504609 and 519190, the N-methylolazoles disclosed in JP-A-4-362943 in place of formaldehyde in a stabilizing solution, and the use of surfactant solution containing 2-equivalent magenta coupler and not containing image stabilizers such as formaldehyde are preferred from the work environmental protection.

Further, the stabilizing solution disclosed in JP-A-6-289559 can preferably be used to reduce the adhesion of dusts to a magnetic recording layer coated on a photographic material.

The replenishment rate of washing water and a stabilizing solution is preferably from 80 to 1,000 ml, more preferably from 100 to 500 ml, and still more preferably from 150 to 300 ml, per $m^2$ of the photographic material, which is a preferred range from both sides of the security of washing or stabilizing function and the reduction of waste solution for environmental protection. In processing with such a replenishment rate, it is preferred to use known fungicides such as thiabendazole, 1,2-benzisothiazolin-3-one, and 5-chloro-2-methylisothiazolin-3-one, antibiotics such as gentamicin, and deionized water by ion exchange resin to prevent proliferation of bacteria and fungus. It is more effective to use deionized water with biocides and antibiotics in combination.

The solution in a washing or stabilizing tank is preferably treated by reverse osmosis treatment as disclosed in JP-A-3-46652, JP-A-3-53246, JP-A-3-55542, JP-A-3-121448 and JP-A-3-126030 to reduce the replenishment rate, and in this case a reverse osmosis membrane is preferably a low pressure reverse osmosis membrane.

In the processing of the present invention, it is particularly preferred to conduct the compensation of evaporation of processing solutions as disclosed in Hatsumei-Kyokai, Kokai-Giho, Kogi No. 94-4992, In particular, according to formula-1 on page 2 of the above literature, the method of compensation based on the information of the temperature and humidity of the atmosphere where the processor is installed is preferred. The water to be used for the compensation of evaporation is preferably drawn from the replenisher tank of water washing, and in such a case deionized water is preferably used as the water washing replenisher.

The processing chemicals disclosed in line 15, right column, page 3 to line 32, left column, page 4 of the above Kokai Giho are preferably used in the present invention. The film processor disclosed in lines 22 to 28, right column, page 3 of the above Kokai Giho is preferably used therefor.

Preferred processing chemicals, automatic processors, and specific examples of the evaporation compensation method for carrying out the present invention are disclosed in line 11, right column, page 5 to the last line, right column, page 7 of the above Kokai Giho.

The processing chemicals for use in the present invention may be supplied in any form such as the solution of the concentration of the working solutions, concentrated solutions, granulated powders, dusting powders, tablets, paste or emulsions. As examples of such processing chemicals, there are solution chemicals contained in a low oxygen permeable container disclosed in JP-A-63-17453, vacuum packaged dusting powders and granulated powders disclosed in JP-A-4-19655 and JP-A-4-230748, granulated powders containing water-soluble polymers disclosed in JP-A-4-221951, tablets disclosed in JP-A-51-61837 and JP-A-6-102628, and paste-like processing chemicals disclosed in JP-A-57-500485, and any of these can be used preferably, but from the convenience at the time of use, it is preferred to use solution chemicals previously prepared in the concentration immediately usable as it is.

As the materials of containers for these processing chemicals, polyethylene, polypropylene, polyvinyl chloride, polyethylene terephthalate, and nylon are used alone or as a composite material. Materials are selected according to the levels of the oxygen permeability required. For a color developing solution which is liable to be oxidized, materials of low oxygen permeability are preferred, specifically, polyethylene terephthalate and a composite material of polyethylene and nylon are preferred. These materials preferably have a thickness of from 500 to 1,500 $\mu$m and oxygen permeability of 20 ml/m$^2$•24 hrs•atm or less.

Processing solutions for the color reversal film for use in the present invention are described. The processing for the color reversal film is disclosed in detail in line 5, page 1 to line 5, page 10 and line 8, page 15 to line 2, page 24 of *Kochi Giiutsu* (*Known Techniques*), No. 6 (April 1st, 1991) published by Aztec Co. and the contents are all preferably applicable to the present invention.

In the processing of a color reversal film, an image stabilizer is contained in the adjusting bath or the final bath. Examples of image stabilizers include, in addition to formalin, sodium formaldehyde bisulfite and N-methylolazoles, but considering the work environment, sodium formaldehyde bisulfite or N-methylolazoles are preferred and N-methyloltriazole is particularly preferred of N-methylolazoles. In addition, the above descriptions with respect to color developing solutions, bleaching solutions, fixing solutions and washing water described in the processing of the color negative film can also be preferably applied to the processing of the color reversal films.

As preferred processing chemicals for a color reversal film containing the above contents, E-6 processing chemical manufactured by Eastman Kodak and CR-56 processing chemical manufactured by Fuji Photo Film Co., Ltd. can be cited.

The present invention can be applied to a photographic material having a magnetic recording layer.

A magnetic recording layer for use in the present invention is a layer coated on a support with an aqueous or organic solvent based coating solution comprising magnetic grains dispersed in a binder.

Examples of the magnetic grains which can be used in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the grain may be any of an acicular, granular, spherical, cubic, or plate-like shape. The specific surface area ($S_{BET}$) is preferably 20 m$^2$/g or more, and particularly preferably 30 m$^2$/g or more. The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic grains may be surface treated with silica and/or alumina and organic materials. Further, the surface of the magnetic grains may be treated with a silane coupling agent 3 or a titanium coupling agent as disclosed in JP-A-6-161032. In addition, the magnetic grains the surfaces of which are covered with inorganic or organic substance as disclosed in JP-A-4-259911 and JP-A-5-81652 can also be used.

The binders which can be used for the magnetic grains includes the thermoplastic resins, thermosetting resins, radiation curable resins, reactive type resins, acid-, alkali- or biodegradable polymers, natural polymers (e.g., cellulose derivatives, sugar derivatives), and mixtures thereof disclosed in JP-A-4-219569. The above described resins have a Tg of from −40° C. to 300° C., and a weight-average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri) acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

The above magnetic substances are dispersed in a binder preferably using, as disclosed in JP-A-6-35092, a kneader, a pin type mill, and an annular type mill, and the combined use thereof is also preferred. The dispersants disclosed in JP-A-5-88283 or other known dispersants can be used. The thickness of a magnetic recording layer is from 0.1 $\mu$m to 10 $\mu$m, preferably from 0.2 $\mu$m to 5 $\mu$m, and more preferably from 0.3 $\mu$m to 3 $\mu$m. The weight ratio of the magnetic grains to the binder is preferably from 0.5/100 to 60/100, and more preferably from 1/100 to 30/100. The coating amount of the magnetic grains is from 0.005 to 3 g/m$^2$, preferably from 0.01 to 2 g/m$^2$, and more preferably from 0.02 to 0.5 g/m$^2$. Transmission yellow density of a magnetic recording layer is preferably from 0.01 to 0.50, more preferably from 0.03 to 0.20, and particularly preferably from 0.04 to 0.15. A magnetic recording layer can be provided on the back surface of the photographic support entirely or in stripe by coating or printing. Coating of a magnetic recording layer can be carried out by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may be provided with functions of lubrication improvement, curling adjustment, antistatic property, adhesion prevention and head abrasion, or another functional layer having these functions may be provided, and at least one kind or more of the grains are preferably abrasives of non-spherical inorganic grains having Mohs' hardness of 5 or more. The composition of the non-spherical inorganic grain is preferably oxide such as aluminum oxide, chromium oxide, silicon dioxide, titanium dioxide, silicon carbide, etc., carbide such as silicon carbide and titanium carbide, and fine powders such as diamond. The surface of these abrasives may be treated with a silane coupling agent or a titanium coupling agent. These grains may be added to a magnetic recording layer, or may be overcoated on a magnetic recording layer (e.g., a protective layer, a lubricating layer). The above described binders can be used at this time, preferably the same binders as the binder of the magnetic recording layer are used. Photographic materials having magnetic recording layers are disclosed in U.S. Pat. Nos. 5,336,589, 5,250,404, 5,229,259, 5,215,874 and European Patent 466130.

The polyester support for use in the present invention is described below, but details including photographic materials described later, processing, cartridges and examples are disclosed in Kokai-Giho, Kogi No. 94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester comprising from 50 mol % to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more to less than Tg for the purpose of being reluctant to get curling habit. The heat treatment may be carried out at constant temperature within this range or may be carried out with cooling. The heat treatment time is preferably from 0.1 hours to 1,500 hours, more preferably from 0.5 hours to 200 hours. The heat treatment of the support may be carried out in a roll state or may be carried out in a web state while transporting. The surface of the support may be provided with concave and convex (e.g., coating conductive inorganic fine grains such as $SnO_2$ or $Sb_2O_5$) to improve the surface state. Further, it is desired to contrive so as to prevent cut end photographing of the core part by providing knurling at the end part and making only the end part a little high. The heat treatment may be carried out at any stage of after formation of the support, after the surface treatment, after coating of a backing layer (an antistatic agent, a sliding agent, etc.), or after undercoating, but preferably conducted after coating of an antistatic agent.

An ultraviolet absorbing agent may be incorporated into the polyester support. Further, light piping can be prevented by including the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment.

An undercoating method is described below. An undercoat layer may be a single layer or may be two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-s-triazine), epichlorohydrin resins, and active vinyl sulfone compounds. $SiO_2$, TiO2, inorganic fine grains or polymethyl methacrylate copolymer fine grains (0.01 to 10 $\mu$m) may be contained as a matting agent.

Further, antistatic agents are preferably used in the present invention. Examples of such antistatic agents include high polymers containing carboxylic acid and carboxylate or sulfonate, cationic polymer, and ionic surfactant compounds.

The most preferred antistatic agents are fine grains of a crystalline metal oxide of at least one grain selected from ZnO, $TiO_2$, $SnO_2$, $Al_2O_3$, $In_2O_3$, $SiO_2$, MgO, BaO, MoO3 and $V_2O_5$ having a volume resistivity of $10^7\Omega$•cm or less, more preferably $10^5\Omega$•cm or less and having a grain size of from 0.001 to 1.0 $\mu$m or fine grains of composite oxides of them (Sb, P, B, In, S, Si, C), further, fine grains of a metal oxide in the form of sol or fine grains of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the photographic material of the present invention to have a sliding property. The sliding agent-containing layer is preferably provided on both of light-sensitive layer surface and backing layer surface. Preferred sliding property is a dynamic friction coefficient of from 0.25 to 0.01. Measurement at this time is conducted using a stainless steel ball having a diameter of 5 mm at a transporting speed of 60 cm/min (25° C., 60% RH). In this evaluation, when the opposite material is replaced with the light-sensitive layer surface, almost the same level of value can be obtained.

Examples of the sliding agents which can be used in the present invention include polyorganosiloxane, higher fatty acid amide, higher fatty acid metal salt, higher fatty acid and higher alcohol ester. As polyorganosiloxane, polydimethylsiloxane, polydiethylsiloxane, polystyrylmethylsiloxane, and polymethylphenylsiloxane can be used. The addition layer is preferably the outermost layer of the emulsion layer or a backing layer. In particular, polydimethylsiloxane or esters having a long chain alkyl group are preferred.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various antistatic agents, and carbon black, metal oxide grains, nonionic, anionic, cationic and betaine based surfactants or polymers can be preferably used. Such a patrone static prevented is disclosed in JP-A-1-312537 and JP-A-1-312538. In particular, those having the resistivity of $10^{12}\Omega$ or less at 25° C., 25% RH are preferred. Usually, plastic patrone is produced using plastics including carbon black or a pigment to impart light shielding. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 $cm^3$ or less and preferably 25 $cm^3$ or less. The weight of the plastics used for the patrone and patrone case is preferably from 5 g to 15 g.

Further, the patrone may be a type of sending out the film by revolving a spool. Further, it may be the structure such that the tip of the film is encased in the body of the patrone and the tip of the film is sent to outside through the port of the patrone by revolving the axle of the spool in the feeding direction of the film. These are disclosed in U.S. Pat. Nos. 4,834,306 and 5,226,613. The photographic film for use in the present invention may be a so-called raw film before development or may be a photographic film development processed. Further, a raw film and a processed film may be contained in the same patrone, or may be stored in different patrones.

The present invention will be illustrated in more detail with reference to examples, but these are not to be construed as limiting the present invention.

(1) Evaluation of Grain Size

A grain dispersed solution was cast-dried on a copper thin film and a sample coated with Au was magnified 1,500 times and photographed with a scanning type electron microscope (JSM-5400, JEOL Ltd.). Compensation of magnification was conducted by simultaneously photographing diffraction grating (500 lines/mm). Using the obtained photograph, 200 or more sectional area diameters of the grains per one sample were measured using particle size analyzer TGZ-3 (Carl Zeiss Co.), and number-average particle size (grain size) was obtained, then standard deviation was calculated and variation coefficient was computed according to the above-described equation (1).

(2) Measurement of Molecular Weiqht 0.1 g of the grain dispersed solution was dissolved in 10 ml of tetrahydrofuran and after being filtered, gel permeation chromatography was conducted, and number-average molecular weight (Mn) and molecular weight distribution (Mw/Mn) in terms of polystyrene were obtained using analytical curve previously prepared with a polystyrene standard sample.

Polystyrene Standard Sample:

F-80 ($Mw=7.06\times10^{5,}$ Mw/Mn=1.05),

F-20 ($MW=1.9\times10^{5,}$ Mw/Mn1.04),

F-4 ($Mw=4.39\times10^{4,}$ Mw/Mn=1.01),

A-5000 ($Mw=5.5\times10^{3,}$ Mw/Mn=1.03)

(all commercially available from Tosoh Corporation)

(3) Synthesis of Grains

SYNTHESIS EXAMPLE 1

Synthesis of monodispersed poly(methyl methacrylate-co-acetoacetoxyethyl methacrylate) grains (Polymer 18)

1.0 g of polyvinylpyrrolidone and 225 g of methanol were put in a 500 ml three-necked flask and nitrogen was introduced thereinto with stirring. Subsequently, the temperature of the solution was raised to 55° C., and 15 g of methyl methacrylate, 10 g of acetoacetoxyethyl methacrylate, and 0.5 g of 2,2'-azobis(isobutyronitrile) were added to the flask. After 48 hours, the reaction solution was cooled, filtrated, and 221.3 g of milky white poly(methyl methacrylate-co-acetoacetoxyethyl methacrylate) grain dispersion was obtained (solid concentration: 10.9 wt %).

Number-average molecular weight: 23,800

Molecular weight distribution (Mw/Mn): 4.0

Grain size: 5.9 μm

Variation coefficient: 0.040

Yield of solid part: 96%

SYNTHESIS EXAMPLE 2

Synthesis of monodispersed poly(methyl methacrylate-co-qlycidyl methacrylate) grains (Polymer 19)

1.5 g of polyvinylpyrrolidone and 225 g of methanol were put in a 500 ml three-necked flask and nitrogen was introduced thereinto with stirring. Subsequently, the temperature of the solution was raised to 55° C., and 17.5 g of methyl methacrylate, 7.5 g of glycidyl methacrylate, and 1.0 g of 2,2'-azobis(isobutyronitrile) were added to the flask. After 48 hours, the reaction solution was cooled, filtrated, and 222.1 g of milky white poly(methyl methacrylate-co-glycidyl methacrylate) grain dispersion was obtained (solid concentration: 11.1 wt %).

Number-average molecular weight: 22,900

Molecular weight distribution (Mw/Mn): 3.7

Grain size: 5.1 μm

Variation coefficient: 0.047

Yield of solid part: 99%

SYNTHESIS EXAMPLE 3

Synthesis of monodispersed poly(methyl methacrylate-co-chloromethylstyrene) grains (Polymer 23)

4 g of polyvinylpyrrolidone, 440 g of methanol and 55 g of ethanol were put in a 1,000 ml three-necked flask and nitrogen was introduced thereinto with stirring. Subsequently, the temperature of the solution was raised to 55° C., and 49.5 g of methyl methacrylate, 5.5 g of chloromethylstyrene, and 1.0 g of 2,2'-azobis (isobutyronitrile) were added to the flask. After 96 hours, the reaction solution was cooled, filtrated, and 488.3 g of milky white poly(methyl methacrylate-co-chloromethylstyrene) grain dispersion was obtained (solid concentration: 10.7 wt %).

Number-average molecular weight: 19,800

Molecular weight distribution (Mw/Mn): 4.1

Grain size: 5.6 μm

Variation coefficient: 0.030

Yield of solid part: 95%

COMPARATIVE SYNTHESIS EXAMPLE 1

Synthesis of monodispersed polymethyl methacrylate grains 10.0 g of polyvinylpyrrolidone and 900 g of methanol were put in a 2,000 ml three-necked flask and nitrogen was introduced thereinto with stirring (150 rpm). Subsequently, the temperature of the solution was raised to 50° C., and 100 g of methyl methacrylate and 2.0 g of 2,2'-azobis (isobutyronitrile) were added to the flask. After 48 hours, the reaction solution was cooled, filtrated, and 949 g of milky white polymethyl methacrylate grain dispersion was obtained (solid concentration: 10.8 wt %).

Number-average molecular weight: 29,100

Molecular weight distribution (Mw/Mn): 1.4

Grain size: 5.1 μm

Variation coefficient: 0.038

Yield of solid part: 92%

COMPARATIVE SYNTHESIS EXAMPLE 2

The same procedure as in Comparative Synthesis Example 1 was repeated except for changing the polymerization temperature to 55° C. and dispersion medium to ethanol, and 936 g of polymethyl methacrylate grain dispersion was obtained (solid concentration: 11.4 wt %).

Number-average molecular weight: 17,600

Molecular weight distribution (Mw/Mn): 3.8

Grain size: 6.1 μm

Variation coefficient: 0.024

Yield of solid part: 95%

COMPARATIVE SYNTHESIS EXAMPLE 3

17.5 g of methyl methacrylate, 7.5 g of glycidyl methacrylate and 150 ml of N,N-dimethylacetamide were put in a 500 ml three-necked flask and stirred with heating at 70° C. under a nitrogen atmosphere. 0.6 g of 2,2'-azobis (isobutyronitrile) dissolved in 5 ml of N,N-dimethylacetamide was added thereto and the solution was further stirred for 5 hours with heating. The obtained polymer solution was cooled to room temperature, then poured into 2 liters of distilled water, the precipitate generated was taken out and washed with water, then vacuum dried to obtain 23.3 g of poly(methyl methacrylate-co-glycidyl methacrylate) solid.

Yield: 93%

Number-average molecular weight: 12,100

Molecular weight distribution (Mw/Mn): 2.1

Subsequently, 23.3 g of the obtained polymer solid was dissolved in 80 ml of ethyl acetate, and added to a solution of 10 g of gelatin, 1 g of Aersol OT surfactant and 120 ml of water while vigorously stirring. After being diluted with 200 ml of water, ethyl acetate was distilled off under reduced pressure. Coarse grains of the polymer were filtrated with filters of 300 μm, then 30 μm, thereby poly(methyl methacrylate-co-glycidyl methacrylate) grains were obtained. The polymer grains had a grain size of 4.9 μm and variation coefficient of 0.429.

The above results and other grains synthesized were summarized in Table 1 below.

TABLE 1

| Sample | Polymer | Number-Average Molecular Weight | Molecular Weight Distribution (Mw/Mn) | Number-Average Grain Size (μm) | Variation Coefficient |
|---|---|---|---|---|---|
| Grain 1 (Synthesis Example 1) | Polymer-18 | 23,800 | 4.0 | 5.9 | 0.040 |
| Grain 2 (Synthesis Example 2) | Polymer-19 | 22,900 | 3.7 | 5.1 | 0.047 |
| Grain 3 (Synthesis Example 3) | Polymer-23 | 19,800 | 4.1 | 5.6 | 0.030 |
| Grain 4 | Polymer-25 | — | — | 5.2 | 0.045 |
| Grain 5 | Polymer-27 | 17,600 | 4.2 | 7.2 | 0.051 |
| Grain 7 | Polymer-28 | — | — | 3.6 | 0.035 |
| Grain 8 | Polymer-30 | — | — | 9.0 | 0.061 |
| Grain 9 | Polymer-36 | 28,100 | 4.6 | 5.1 | 0.039 |
| Comparative Grain 1 (Comparative Example 1) | Polymethyl Methacrylate | 29,100 | 1.4 | 5.1 | 0.038 |
| Comparative Grain 2 (Comparative Example 2) | Polymethyl Methacrylate | 17,600 | 3.8 | 6.1 | 0.024 |
| Comparative Grain 3 (Comparative Example 3) | Polymer-23 | 12,100 | 2.1 | 4.9 | 0.429 |

EXAMPLE 1

A conductive layer and a backing layer each having the composition shown below were simultaneously coated on one side of a biaxially stretched polyethylene terephthalate support (thickness: 100 μm) both surfaces of which were provided with undercoat layers.

| Conductive Layer | | |
|---|---|---|
| $SnO_2$/Sb (9/1 by weight ratio, average grain size: 0.25 μm) | 200 | mg/m$^2$ |
| Gelatin ($Ca^{++}$ content: 3,000 ppm) | 77 | mg/m$^2$ |
| Compound-1 | 7 | mg/m$^2$ |
| Sodium Dodecylbenzenesulfonate | 10 | mg/m$^2$ |
| Sodium Dihexyl-α-sulfosuccinato | 40 | mg/m$^2$ |
| Sodium Polystyrenesulfonate | 9 | mg/m$^2$ |

The surface resistivity of the conductive layer at 25° C., 20% RH was $3.0\times10^9$ Ω.

| Backing Layer | |
|---|---|
| Gelatin ($Ca^{++}$ content: 3,000 ppm) | 2.9 g/m$^2$ |
| Compound-1 | 3 mg/m$^2$ |
| Compound-2 | 40 mg/m$^2$ |
| Compound-3 | 40 mg/m$^2$ |
| Compound-4 | 155 mg/m$^2$ |
| Compound-5 | 150 mg/m$^2$ |
| Sodium Dodecylbenzenesulfonate | 7 mg/m$^2$ |
| Sodium Dihexyl-α-sulfosuccinato | 30 mg/m$^2$ |
| 1,2-Bis(vinylsulfonylacetamido)ethane | 140 mg/m$^2$ |
| Polyethyl Acrylate Latex (average grain size: μm) | 430 mg/m$^2$ |
| Sodium Sulfate | 180 mg/m$^2$ |
| Compound-6 | 5 mg/m$^2$ |
| Matting Agent | Shown in Table 2 |

Compound-1

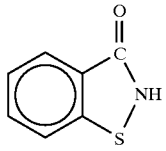

Compound-2

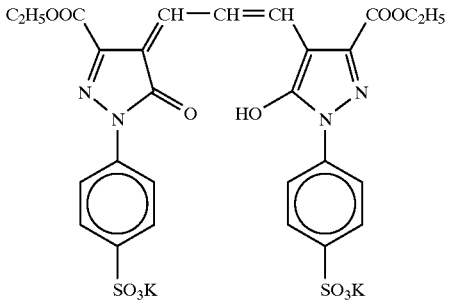

Compound-3

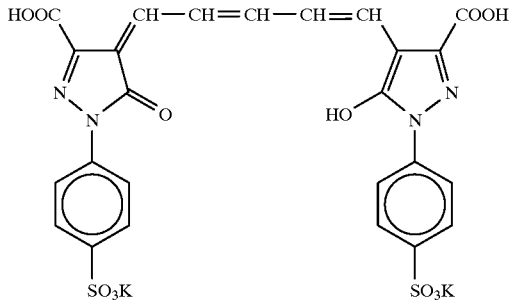

Compound-4

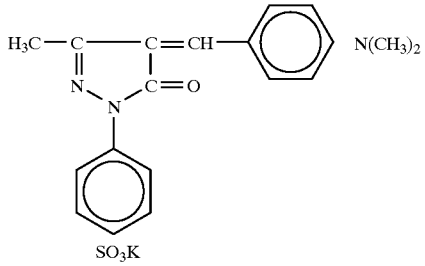

Compound-5

-continued

| Backing Layer |
|---|

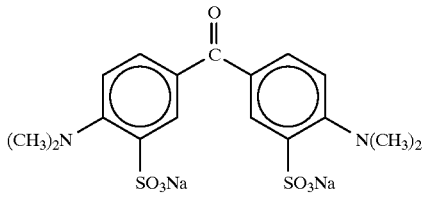

Compound-6
$C_8F_{17}SO_3Li$

Then, a first emulsion layer, a second emulsion layer, a lower protective layer and an upper protective layer were simultaneously coated on the side opposite to the side of the support on which the conductive layer and the backing layer were coated.

First Emulsion Layer

An aqueous solution of silver nitrate and an aqueous solution of sodium chloride containing $2\times10^{-5}$ mol per mol of silver of $(NH_4)_2Rh(H_2O)Cl_5$ were simultaneously added over 7 minutes to an aqueous solution of gelatin, maintained at 40° C., containing 4-hydroxy-6-methyl-1,3,3a,7-tetraazaindene ($5\times10^{-3}$ mol per mol of silver) with controlling the potential during that time at 95 mV, and core grains having a grain size of 0.12 μm was prepared. Subsequently, an aqueous solution of silver nitrate and an aqueous solution of sodium chloride containing $1.2\times10^{-4}$ mol per mol of silver of $(NH4)_2Rh(H_2O)Cl_5$ were simultaneously added thereto over 14 minutes with controlling the potential during that time at 94 mV, and silver chloride cubic grains having an average grain size of 0.15 μm was prepared.

$2.2\times10^{-5}$ mol/m$^2$ of a mixed solution of the following hydrazine compounds 1 and 2 in mol ratio of 1/1, 30 mg/m$^2$ of 4-hydroxy-6-methyl-1,3,3a,7-tetraazaindene, 40 mg/m$^2$ and 10 mg/M$^2$, respectively, of the following compound-7 and compound-8, 0.35 g/m$^2$ of polyethyl acrylate latex, and 140 mg/mZ of 1,1-bis(vinylsulfonyl)methane as a hardening agent were added to the above prepared emulsion, and coated on the support so as to provide a coating amount of silver of 1.55 g/m$^2$ and gelatin of 0.7 g/m$^2$.

Hydrazine Compound 1

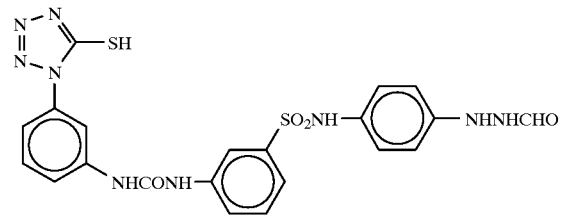

Hydrazine Compound 2

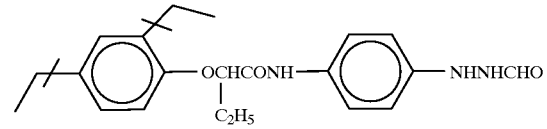

-continued

Compound-7

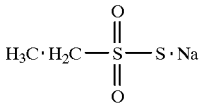

Compound-8

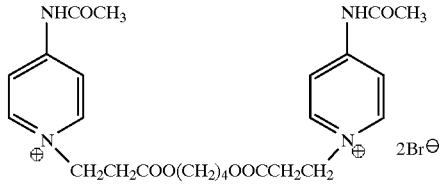

Second Emulsion Layer

An aqueous solution of silver nitrate and an aqueous solution of sodium chloride containing $4\times10^{-5}$ mol per mol of silver of $(NH_4)_2Rh(H_2O)Cl_5$ were simultaneously added over 3 minutes and 30 seconds to an aqueous solution of gelatin, maintained at 40° C., containing 5,6-cyclopentane-4-hydroxy-1,3,3a,7-tetraazaindene ($5\times10^{-3}$ mol per mol of silver) with controlling the potential during that time at 95 mV, and core grains having a grain size of 0.08 μm was prepared. Subsequently, an aqueous solution of silver nitrate and an aqueous solution of sodium chloride containing $1.2\times10^{-4}$ mol per mol of silver of $(NH_4)_2Rh(H_2O)Cl_5$ were simultaneously added thereto over 7 minutes with controlling the potential during that time at 95 mV, and silver chloride cubic grains having an average grain size of 0.10 μm was prepared.

A second emulsion layer was coated in the same manner as the coating of the above first emulsion layer except for using this emulsion, so as to provide a coating amount of silver of 0.95 g/m² and gelatin of 0.44 g/m².

| Lower Protective Layer | | |
|---|---|---|
| Gelatin | 0.50 | g/m |
| Polyethyl Acrylate Latex | 0.25 | g/m² |
| 1-Hydroxy-2-benzaldoxime | 15 | mg/m² |
| Compound-9 | 80 | mg/m² |
| Compound-10 | 10 | mg/m² |
| Upper Protective Layer | | |
| Gelatin | 0.90 | g/m² |
| Matting Agent | Shown in Table 2 | |
| Liquid Paraffin (gelatin dispersion) | 50 | mg/m² |
| Potassium N-Perfluorooctanesulfonyl-N-propylglycine | 5 | mg/m² |
| Sodium Dodecylbenzenesulfonate | 10 | mg/m² |
| *Solid Dispersion Dye A | 80 | mg/m² |
| *Solid Dispersion Dye B | 40 | mg/m² |

*Preparation of Fine Grain Dispersion of Solid Dispersion Dyes A and B

The preparation method in the present invention was corresponding to the method of JP-A-63-197943.

That is, a 6.7% aqueous solution of water (434 ml) and Triton X-200R surfactant (TX-200R) (53 g) (available from Rohm & Haas) was put in a bottle with a screw cap having a capacity of 1.5 liters. 20 g of the dye and zirconium oxide beads ($ZrO_2$, diameter: 2 mm, 800 ml) were added thereto, the cap of the bottle was tightened, put in a mill and the content was pulverized for 4 days.

The content was added to a 12.5% aqueous solution of gelatin (160 g), put in a roll mill for 10 minutes and foams were reduced. The obtained mixture was filtrated and $ZrO_2$ beads were removed. The average grain size of the grains was 0.3 μm but as coarse grains were still contained, the dispersion was classified by a centrifugal separation method so that the mamimum grain size reached 1 μm or less.

Compound-9

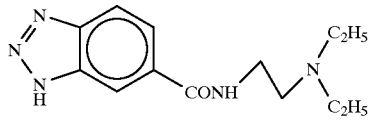

Compound-10

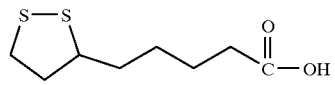

Solid Dispersion Dye A

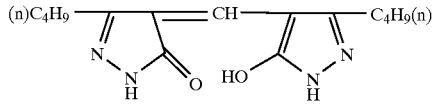

Solid Dispersion Dye B

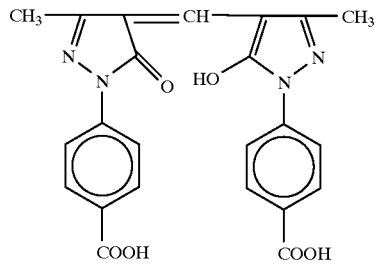

After the obtained sample was preserved at 25° C., 50% RH for 1 week, the following evaluations were conducted.

(1) Beck's Smoothness

Smoothness of the sample (unprocessed) was measured under 25° C., 50% RH atmosphere using an Ohken type smoothness tester (manufactured by Asahi Seiko Co.). (A method corresponding to JIS P8119)

(2) Photographic Properties

Sample was exposed through an optical wedge with a bright room printer FPA-800FX (Fresnel lens was used) manufactured by Fuji Photo Film Co., Ltd., and processed at 38° C., for 20 seconds using developing solution (I) and fixing solution (I) each having the composition shown below with automatic processor FG-680AG (manufactured by Fuji Photo Film Co., Ltd.).

Sensitivity is a logarithmic value of an exposure amount giving the density and was expressed in a relative value taking Sample No. 1 as 100.

γ value shows average gradient from density 0.3 to 3.0 on the characteristic curve, and is expressed by the value obtained by dividing 2.7 with ΔlogE (difference between the logarithmic value of exposure amount giving density 3.0 and the logarithmic value of exposure amount giving density 0.3). The higher the value, the higher is the contrast of the image.

$D_m$ means the maximum density value on the characteristic curve.

(3) Haze

An unexposed sample was development processed in the same manner as the above (2) and the haze of the sample was measured using Color & Color Difference Meter MODEL NDH-100DP (manufactured by Nihon Denshoku Industry Co., Ltd.).

Haze (%)=(scattered light amount÷total transmitted light amount)×100

Compositions of developing solution (I) and fixing solution (I) are as follows.

| Developing Solution (I) | | |
|---|---|---|
| Potassium Hydroxide | 90.0 | g |
| Sodium Hydroxide | 8.0 | g |
| Sodium Ethylenediaminetetraacetate | 1.0 | g |
| Boric Acid | 24.0 | g |
| Sodium Metabisulfite | 65.0 | g |
| Potassium Bromide | 10.0 | g |
| Hydroquinone | 55.0 | g |
| 5-Methylbenzotriazole | 0.40 | g |
| N-methyl-p-aminophenol | 0.50 | g |
| Sodium 2-Mercaptobenzimidazole-5-sulfonate | 0.30 | g |
| Sodium 3-(5-Mercaptotetrazole)benzenesulfonate | 0.20 | g |
| N-n-Butyl-diethanolamine | 14.0 | g |
| N,N-Dimethylamino-6-hexanol | 0.20 | g |
| Sodium Toluenesulfonate | 8.0 | g |
| 5-Sulfosalicylic Acid | 23.0 | g |
| Water to make | 1 | liter |
| pH (adjusted with potassium hydroxide) | 11.9 | |
| Replenishment rate was 240 ml/m$^2$. | | |
| **Hardening Fixing Solution (I)** | | |
| Ammonium Thiosulfate | 359.1 | g |
| Disodium Ethylenediaminetetraacetate Dihydrate | 0.092 | g |
| Sodium Thiosulfate Pentahydrate | 32.8 | g |
| Sodium Sulfite | 75.0 | g |
| NaOH (fineness) | 37.2 | g |
| Glacial Acetic Acid | 87.3 | g |
| Tartaric Acid | 8.76 | g |
| Sodium Gluconate | 5.2 | g |
| Aluminum Sulfate | 25.3 | g |
| Water to make | 1 | liter |
| pH (adjusted with sulfuric acid or sodium hydroxide) | 4.85 | |

A working solution was prepared by adding 2 liters of water thereto.

The results obtained are shown in Table 2 below.

| Conductive Layer | | |
|---|---|---|
| $SnO_2$/Sb (9/1 by weight ratio, average grain size: 0.25 $\mu$m) | 200 | mg/m$^2$ |
| Gelatin ($Ca^{++}$ content: 3,000 ppm) | 77 | mg/m$^2$ |
| Compound-(1) | 7 | mg/m$^2$ |
| Sodium Dodecylbenzenesulfonate | 10 | mg/m$^2$ |
| Sodium Dihexyl-α-sulfosuccinato | 40 | mg/m$^2$ |
| Sodium Polystyrenesulfonate | 9 | mg/m$^2$ |

The surface resistivity of the conductive layer at 25° C., 20% RH was $3.0\times10^9$ Ω.

| Backing Layer | | |
|---|---|---|
| Gelatin ($Ca^{++}$ content: 30 ppm) | 2.82 | g/m$^2$ |
| Compound-(1) | 3 | mg/m$^2$ |
| Matting Agent | Shown in Table 3 | |
| Compound-(2) | 40 | mg/m$^2$ |
| Compound-(3) | 40 | mg/m$^2$ |
| Compound-(4) | 80 | mg/m$^2$ |
| Sodium Dodecylbenzenesulfonate | 75 | mg/m$^2$ |
| Sodium Dihexyl-α-sulfosuccinato | 20 | mg/m$^2$ |
| Compound-(5) | 5 | mg/m$^2$ |
| Potassium N-Perfluorooctanesulfonyl-N-propylglycine | 7 | mg/m$^2$ |
| Sodium Sulfate | 50 | mg/m$^2$ |
| Sodium Acetate | 85 | mg/m$^2$ |
| 1,2-Bis(vinylsulfonylacetamido)ethane | 150 | mg/m$^2$ |

Compound-(1)

TABLE 2

| Sample No. | Matting Agent: Backing Layer (mg/m$^2$) | | Matting Agent: Upper Protective Layer (mg/m$^2$) | | Beck's Smoothness: Emulsion Layer Side (sec) | Beck's Smoothness: Backing Layer Side (sec) | Sensitivity | γ Value | $D_m$ | Haze (%) |
|---|---|---|---|---|---|---|---|---|---|---|
| 1 (Invention) | Grain 1 | 40 | Grain 2 | 35 | 670 | 330 | 100 | 11 | 5.5 | 6.3 |
| 2 (Invention) | Grain 1 | 40 | Grain 3 | 30 | 660 | 330 | 100 | 11 | 5.5 | 5.5 |
| 3 (Invention) | Grain 1 | 40 | Grain 4 | 35 | 660 | 330 | 100 | 11 | 5.5 | 6.5 |
| 4 (Invention) | Grain 1 | 40 | Grain 9 | 35 | 670 | 330 | 100 | 11 | 5.5 | 6.3 |
| 5 | Comparative Grain 2 | 35 | Comparative Grain 1 | 40 | 700 | 350 | 100 | 9 | 5.3 | 6.5 |
| 6 | Comparative Grain 2 | 35 | Comparative Grain 3 | 40 | 680 | 350 | 100 | 7 | 4.4 | 8.0 |

As is apparent from Table 2, samples of the present invention containing a monodispersed matting agent having a reactive functional group show high contrast, high $D_m$ and haze cutting is good.

EXAMPLE 2

A conductive layer and a backing layer each having the composition shown below were coated on one side of a biaxially stretched polyethylene terephthalate support (thickness: 100 $\mu$m) both surfaces of which were provided with undercoat layers.

-continued

| Backing Layer |
|---|

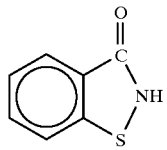

Compound-(2)

-continued

Backing Layer

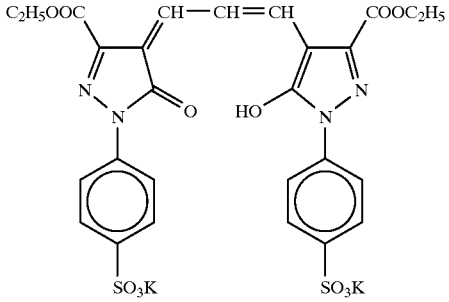

Compound-(3)

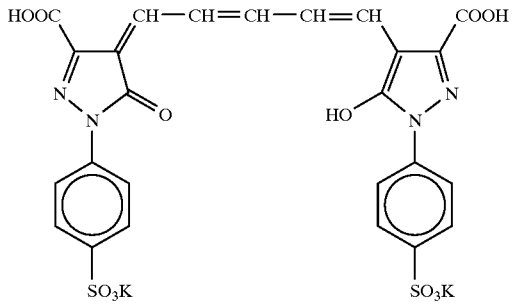

Compound-(4)

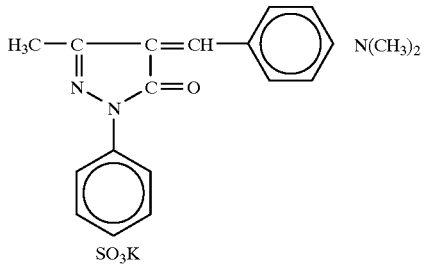

Compound-(5)
$C_8F_{17}SO_3Li$

Then, an emulsion layer, a lower protective layer and an upper protective layer were simultaneously coated on the side opposite to the side of the support on which the conductive layer and the backing layer were coated.

| First Emulsion Layer<br>Preparation of Emulsion | | |
|---|---|---|
| Solution I | | |
| Water | 1,000 | ml |
| Gelatin | 20 | g |
| Sodium Chloride | 20 | g |
| 1,3-Dimethylimidazolidine-2-thione | 20 | g |
| Sodium Benzenesulfonate | 6 | mg |
| Solution II | | |
| Water | 400 | ml |
| Silver Nitrate | 100 | g |
| Solution III | | |
| Water | 400 | ml |
| Sodium Chloride | 30.5 | g |

-continued

| First Emulsion Layer<br>Preparation of Emulsion | | |
|---|---|---|
| Potassium Bromide | 14 | g |
| Potassium Hexachloroiridate (III)<br>(0.001% aqueous solution) | 15 | ml |
| Ammonium Hexabromorhodate (III)<br>(0.001% aqueous solution) | 1.5 | ml |

Solution II and Solution III were at the same time added to Solution I maintained at 38° C., pH 4.5 with stirring over 10 minutes and fine grains having a grain size of 0.16 μm were formed. Subsequently, Solutions IV and V shown below were added to the above emulsion over 10 minutes. Further, 0.15 g of potassium iodide was added thereto and grain formation was terminated.

| | | |
|---|---|---|
| Solution IV | | |
| Water | 400 | ml |
| Silver Nitrate | 100 | g |
| Solution V | | |
| Water | 400 | ml |
| Sodium Chloride | 30.5 | g |
| Potassium Bromide | 14 | g |
| $K_4Fe(CN)_6$ | $1 \times 10^{-5}$ | mol/mol Ag |

Subsequently, the reaction product obtained was washed with water according to an ordinary flocculation method, and 40 g of gelatin was added.

After adjusting the pH to 5.3 and the pAg to 7.5, 5.2 mg of sodium thiosulfate, 10.0 mg of chloroauric acid, and 2.0 mg of N,N-dimethylselenourea were added, then 8 mg of sodium benzenesulfonate, 2.0 mg of sodium benzenesulfinate were added and chemical sensitization was conducted at 550° C. as to provide optimal sensitivity, and finally silver iodochlorobromide cubic grain emulsion containing 80 mol % of silver chloride and having an average grain size of 0.20 μm was obtained.

Then, $3\times10^{-4}$ mol/mol Ag of Sensitizing Dye 1 was added, and further, 300 mg per mol of Ag of disodium 4,4'-bis(4,6-dinaphthoxy-pyrimidin-2-ylamino) stilbenedisulfonate as a supersensitizer and a stabilizer was added and panchromatic sensitization was conducted.

Further, 2.5 g and 50 mg, per mol of Ag, respectively, of hydroquinone and 1-phenyl-5-mercaptotetrazole as antifoggants were added, then colloidal silica (Snowtex C, average grain size: 0.015 μm, manufactured by Nissan Chemical Industries, Ltd.) was added in an amount of 30 wt % based on gelatin, then polyethyl acrylate latex as a plasticizer in an amount of 40 wt % based on gelatin, and 100 mg/m$^2$ of 1,1'-bis(vinylsulfonyl)methane as a hardening agent were added.

This coating solution was coated on the support as to provide a coated silver weight of 3.3 g/m$^2$ and a coated gelatin weight of 1.5 g/m$^2$.

Sensitizing Dye 1

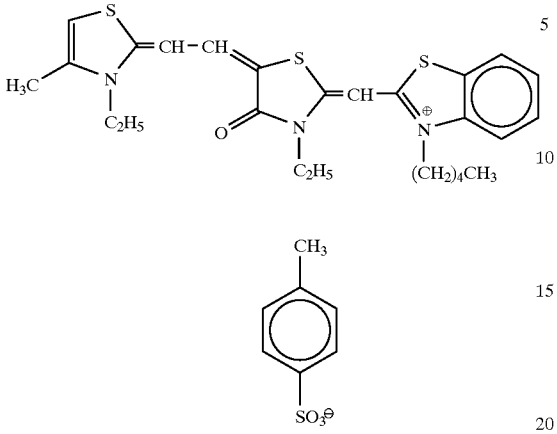

Lower Protective Layer

| | | |
|---|---|---|
| Gelatin | 0.5 | g/m$^2$ |
| Sodium Benzenesulfonate | 4 | mg/m$^2$ |
| 1,5-Dihydroxy-2-benzaldoxime | 25 | mg/m$^2$ |
| Polyethyl Acrylate Latex | 125 | mg/m$^2$ |

Upper Protective Layer

| | | |
|---|---|---|
| Gelatin | 0.25 | g/m$^2$ |
| Matting Agent | Shown in Table 3 | |
| Compound-(6) (gelatin dispersion of a sliding agent) | 30 | mg/m$^2$ |

-continued

| | | |
|---|---|---|
| Colloidal Silica (Snowtex C, Nissan Chemical Industries, Ltd.) | 30 | mg/m$^2$ |
| Compound-(7) | 5 | mg/m$^2$ |
| Sodium Dodecylbenzenesulfonate | 22 | mg/m$^2$ |

Friction coefficient of this sample was all 0.22±0.03 (25° C., 60% RH, a sapphire needle ϕ=1 mm, load: 100 g, speed: 60 cm/min).

Compound-(6)

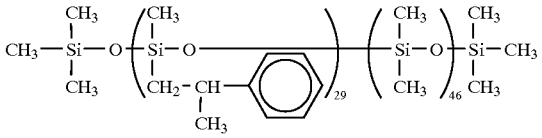

Compound-(7)

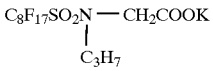

Samples obtained were evaluated in the same manner as in Example 1. Evaluation of photographic properties was conducted as follows.

(1) Photoqraphic Properties

The samples obtained were exposed with a xenon flash light with an exposure time of $10^{-6}$ sec through an interference filter having a peak at 633 nm and continuous density wedge and development processed using an automatic processor FG-680AS manufactured by Fuji Photo Film Co., Ltd., and sensitivity and γ value were obtained in the same manner as in Example 1.

The developing solution and the fixing solution used were SR-D2 and SR-F1, respectively, manufactured by Fuji Photo Film Co., Ltd. and development conditions were 38° C. and 11 seconds.

The results obtained are shown in Table 3 below.

TABLE 3

| | Matting Agent | | | | Beck's Smoothness | | | | | |
|---|---|---|---|---|---|---|---|---|---|---|
| Sample No. | Backing Layer (mg/m$^2$) | | Upper Protective Layer (mg/m$^2$) | | Emulsion Layer Side (sec) | Backing Layer Side (sec) | Sensitivity | γ Value | $D_m$ | Haze (%) |
| 7 (Invention) | Grain 1 | 40 | Grain 2 | 35 | 690 | 330 | 100 | 9 | 5.3 | 6.2 |
| 8 (Invention) | Grain 1 | 40 | Grain 3 | 30 | 680 | 330 | 100 | 9 | 5.3 | 5.3 |
| 9 (Invention) | Grain 1 | 40 | Grain 4 | 35 | 680 | 330 | 100 | 9 | 5.3 | 6.3 |
| 10 (Invention) | Grain 1 | 40 | Grain 9 | 35 | 690 | 330 | 100 | 9 | 5.3 | 6.2 |
| 11 | Comparative Grain 2 | 35 | Comparative Grain 1 | 40 | 720 | 350 | 100 | 7 | 5.1 | 6.3 |
| 12 | Comparative Grain 2 | 35 | Comparative Grain 3 | 40 | 700 | 350 | 100 | 5 | 4.4 | 7.8 |

As is apparent from Table 3, samples of the present invention containing a monodispersed matting agent having a reactive functional group show high contrast, high $D_m$ and haze cutting is good.

EXAMPLE 3

Samples were prepared by replacing (i) the polymethyl methacrylate fine grains in the backing layer and the upper protective layer in Example 5 of JP-A-7-234478; (ii) the polymethyl methacrylate fine grains in the backing protective layer and the $SiO_2$ matting agent in the OC layer in Example 7 of JP-A-7-234478; and (iii) the polymethyl methacrylate fine grains in the backing protective layer and the SiO2 matting agent in the protective layer in Example 8 of JP-A-7-234478, with the matting agents Grain 1 and Grain 2 of Sample No. 1 in Example 1 of the present invention which have functional groups, respectively, and the same evaluation in Example 1 of the present invention was conducted for these samples. As a result, the same results as in Example 1 were obtained.

EXAMPLE 4

Sample Nos. 6 to 9 in Example 2 were processed using a direct scanner graph SG-737 (a product of Dainippon Screening Co.) and an automatic processor FG-680AS (a product of Fuji Photo Film Co., Ltd.). Each sample showed good transporting property, less electrostatic charge, strong scratch resistance, and a matting agent was scarcely peeled off.

A silver halide photographic material having improved in antistatic property, transporting property, transparency, scratch resistance, drying property, and, in particular, excellent in improving mat pinholes can be obtained by the present invention.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon a silver halide emulsion layer and at least one hydrophilic colloid layer constituting the silver halide photographic material contains a monodispersed polymer having an average grain size of from 1 to 10 $\mu$m and variation coefficient of 0.10 or less and having a functional group which forms a covalent bond by reacting with an organic hardening agent or gelatin.

2. The silver halide photographic material as claimed in claim 1, wherein the polymer is a polymer obtained by polymerization by adding to a hydrophilic organic solution a high molecular weight dispersant which is dissolved in said hydrophilic organic solution and further adding at least one vinyl monomer which is dissolved in said hydrophilic organic solution but the polymer to be formed is precipitated from said hydrophilic organic solution.

3. The silver halide photographic material as claimed in claim 1, wherein the polymer contains 60 wt % or more of a repeating unit derived from methyl methacrylate.

4. The silver halide photographic material as claimed in claim 2, wherein the polymer contains 60 wt % or more of a repeating unit derived from methyl methacrylate.

5. The silver halide photographic material as claimed in claim 1, wherein the polymer has a glass transition point of 60° C. or more.

* * * * *